US007334610B2

(12) United States Patent
Levin et al.

(10) Patent No.: US 7,334,610 B2
(45) Date of Patent: Feb. 26, 2008

(54) HARNESS BOARD FIXTURE

(75) Inventors: Robert F. Levin, Braceville, IL (US); William A. Bernard, Darien, IL (US)

(73) Assignee: Panduit Corp., Tinley Park, IL (US)

( * ) Notice: Subject to any disclaimer, the term of this patent is extended or adjusted under 35 U.S.C. 154(b) by 166 days.

(21) Appl. No.: 11/248,568

(22) Filed: Oct. 12, 2005

(65) Prior Publication Data

US 2006/0076073 A1 Apr. 13, 2006
US 2006/0174964 A9 Aug. 10, 2006

Related U.S. Application Data

(60) Provisional application No. 60/692,679, filed on Jun. 21, 2005, provisional application No. 60/618,492, filed on Oct. 13, 2004.

(51) Int. Cl.
*B21F 9/02* (2006.01)
*B65B 13/04* (2006.01)

(52) U.S. Cl. ..... 140/93.2; 100/25

(58) Field of Classification Search ..... 140/92.1, 140/93.2, 123; 29/755; 100/25, 26, 31, 100/33 R; 53/292; 269/903
See application file for complete search history.

(56) References Cited

U.S. PATENT DOCUMENTS

| | | | | |
|---|---|---|---|---|
| 4,609,910 | A | 9/1986 | Geringer et al. | |
| 4,992,777 | A | 2/1991 | Keisuke et al. | |
| 5,015,996 | A | 5/1991 | Konishi et al. | |
| 5,243,325 | A | 9/1993 | Marin et al. | |
| 5,368,261 | A | 11/1994 | Caveney et al. | |
| 5,430,996 | A | 7/1995 | Kurmis | |
| 5,654,788 | A | 8/1997 | Kuhn, Jr. | |
| 5,714,940 | A | 2/1998 | Fishovitz et al. | |
| 5,799,906 | A | 9/1998 | Hillegonds | |
| 5,845,681 | A | 12/1998 | Kurmis | |
| 5,915,424 | A * | 6/1999 | Franks et al. | 140/92.1 |
| 5,934,341 | A | 8/1999 | Thieme | |
| 6,019,142 | A | 2/2000 | Kurmis | |
| 6,039,089 | A | 3/2000 | Kurmis | |
| 6,467,650 | B1 | 10/2002 | Lesser et al. | |
| 6,513,555 | B1 | 2/2003 | Lesser et al. | |
| 6,557,726 | B2 | 5/2003 | Lesser | |
| 6,640,839 | B2 | 11/2003 | Thieme | |
| 6,655,417 | B2 | 12/2003 | Kurmis | |
| 6,758,247 | B2 | 7/2004 | Thieme | |
| 2002/0108667 | A1 | 8/2002 | Thieme | |

FOREIGN PATENT DOCUMENTS

| | | |
|---|---|---|
| EP | 0 897 866 A | 2/1999 |

* cited by examiner

*Primary Examiner*—Derris H. Banks
*Assistant Examiner*—Teresa M Bonk
(74) *Attorney, Agent, or Firm*—Robert A. McCann; Christopher S. Clancy

(57) ABSTRACT

A harness board fixture with improved mounting features enables better positioning and securing of an automatic cable tie tool to the fixture. The mounting features may be provided on the same side or on opposite sides of an arcuate wire bundle support surface of the fixture. When provided on a same side, multiple mounting or locating features may be located near each other. The opposite side, forming a front of the fixture, may be open to define a readily accessible wire bundle entrance and exit path. The fixture preferably includes a mounting structure for reliably receiving and releaseably holding a push mount by snap-fit and oriented substantially perpendicular to the fixture base or at an angle.

25 Claims, 23 Drawing Sheets

HARNESS BOARD FIXTURE

CROSS-REFERENCE TO RELATED APPLICATIONS

This non-provisional application claims the benefit of U.S. Provisional Application No. 60/618,492 filed Oct. 13, 2004 and U.S. Provisional Application No. 60/692,679 filed Jun. 21, 2005.

BACKGROUND

The invention is directed to a harness board fixture and, more particularly, to a harness board fixture that mountably receives an automatic cable tie tool used to apply a cable tie to a wire bundle positioned on the fixture. The harness board fixture may also mountably receive a push mount to which the cable tie may be applied by the automatic cable tie tool.

SUMMARY

It would be desirable to provide a harness board fixture that can readily, precisely, and securely mount an automatic cable tie tool.

It would further be desirable to provide a harness board fixture with improved mounting features that enable better positioning and securing of the automatic cable tie tool to the fixture. These mounting features may be provided on the same side or on opposite sides of an arcuate wire bundle support surface of the fixture and may include an interengaging mounting pin that engages a jaw of the tool. When provided on a same side, multiple mounting or locating features may be located near each other. Also, when provided on the same side, the opposite side, forming a front of the fixture, may be open to define a readily accessible wire bundle entrance and exit path.

It would be desirable to also provide a harness board fixture with a mounting structure for reliably receiving and releaseably holding a push mount. The push mount and a cable tie may be applied to a wire bundle with an automatic cable tie tool. The push mount may be supported with a snap-fit and oriented substantially perpendicular to the fixture base or at an angle.

It would further be desirable to provide a harness board fixture having a curved wire bundle support surface that forms a guide for routing a cable tie around a wire bundle and into a cable tie head of an automated cable tie installation tool without requiring use of both jaws of the tool to guide the cable tie.

It would also be desirable to provide an automatic cable tie tool configured to interengage a mounting pin of the harness board fixture to more reliably and securely latch the tool to the fixture.

It would further be desirable to provide an automatic cable tie installation tool configured with tool locating features that allow for simpler and/or more secure mounting. These mounting features may be substantially aligned with corresponding mounting structure on the harness board fixture. One of the mounting features may have an angled surface, allowing for guided movement of the automated cable tie tool from a rough initial placement position to a precise mounting position.

It would also be desirable to provide a harness board fixture having one or more sensors to ensure proper cable tie tool operation.

BRIEF DESCRIPTION OF THE DRAWINGS

The invention will be described with reference to the following drawings, wherein.

DETAILED DESCRIPTION OF EMBODIMENTS

Figure 1:
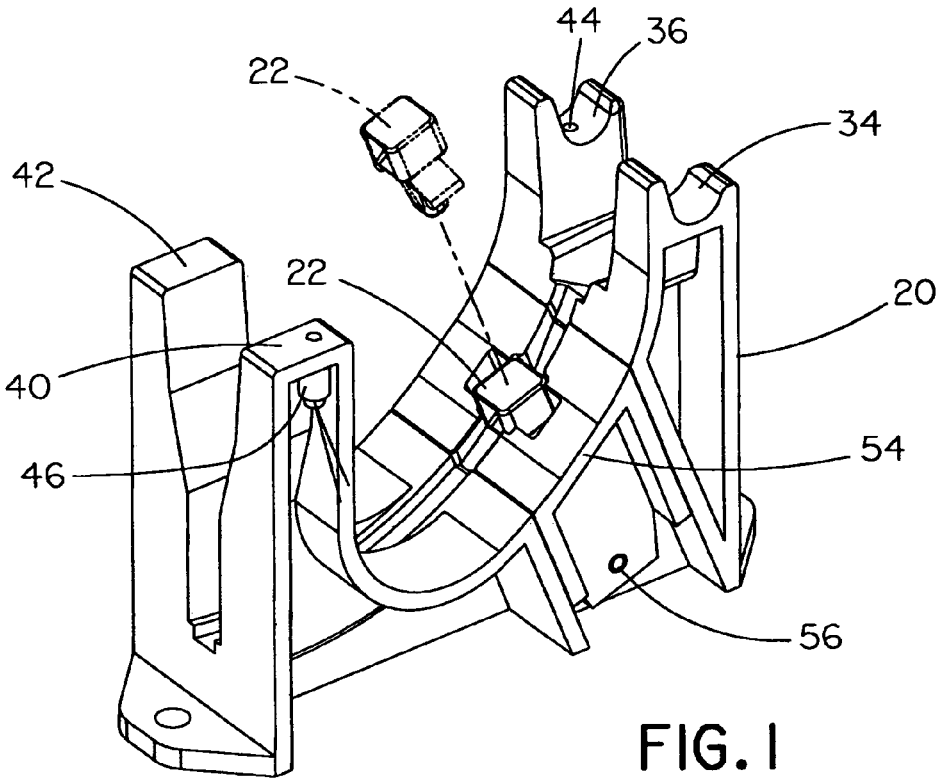
FIG. 1 is a front perspective view of a harness board fixture according to the present invention.
Figure 2:
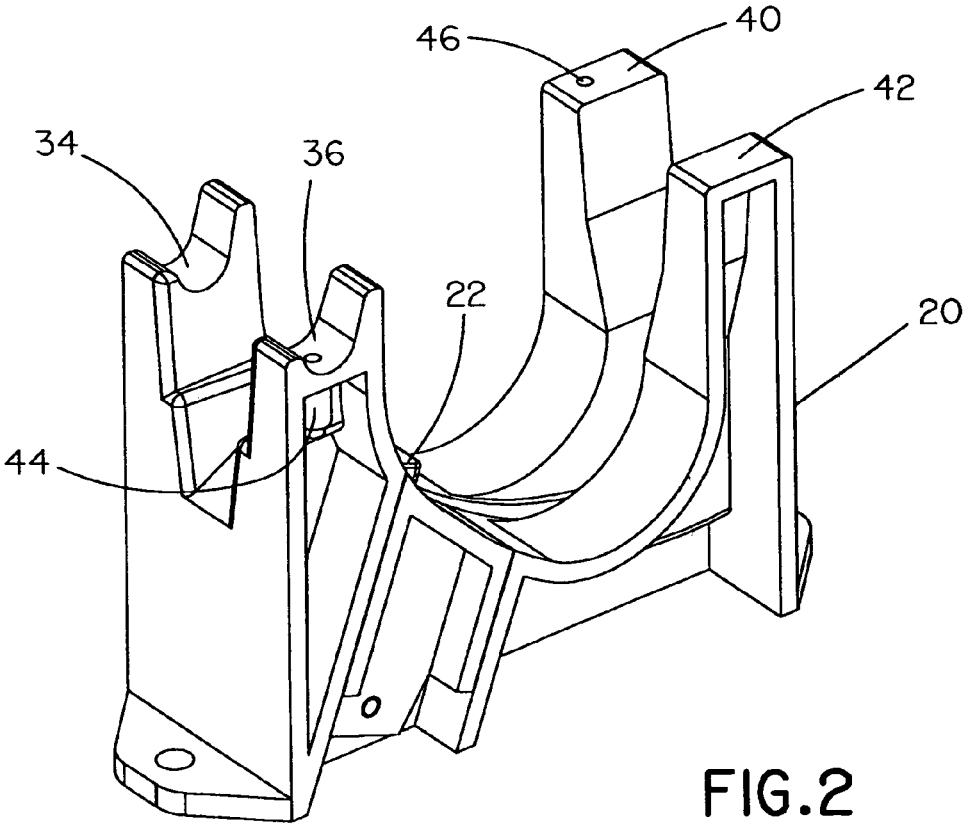
FIG. 2 is a rear perspective view of the harness board fixture of FIG. 1.
Figure 3:
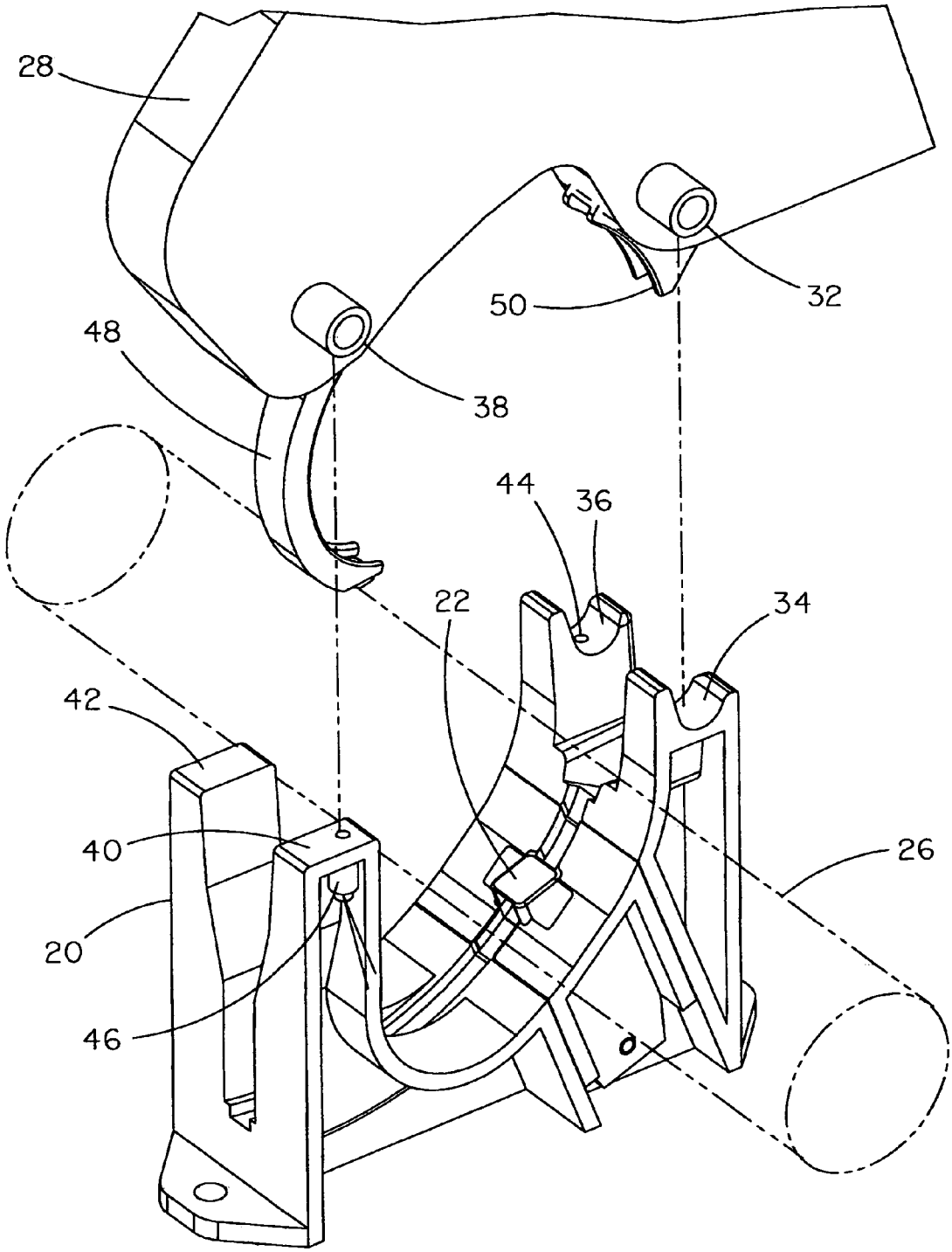
FIG. 3 is a front perspective view of the harness board fixture of FIG. 1, showing a wire bundle positioned therein and a cable tie tool located thereabove.

FIGS. 1-15 illustrate a harness board fixture 20 that may receive a push mount 22 therein. Harness board fixture 20 may be mounted onto a suitable work surface (unshown) and useful in the fabrication of wire harnesses used, for example, in the automotive, appliance and aerospace industries. A cable tie 24 may be applied to a wire bundle 26 provided on the fixture using an automatic cable tie tool 28 that is mountably received by the harness board fixture 20.

Automated cable tie installation tools are known per se. Examples of these tools include those disclosed in U.S. Pat. Nos. 3,946,769; 3,976,108; 4,498,506; and 4,632,247, all assigned to Panduit Corp. and hereby incorporated herein by reference in their entireties. Similar tools are also marketed by Panduit Corp. under the trade name of PAT1M and PAT1.5M automatic cable tie systems. However, exemplary cable tie tools may include additional features described below to mate with harness board fixture 20. Additionally, in certain embodiments, harness board fixture 20 may include one or more sensors 30, 44, 46 to ensure proper cable tie tool operation.

Figure 4:
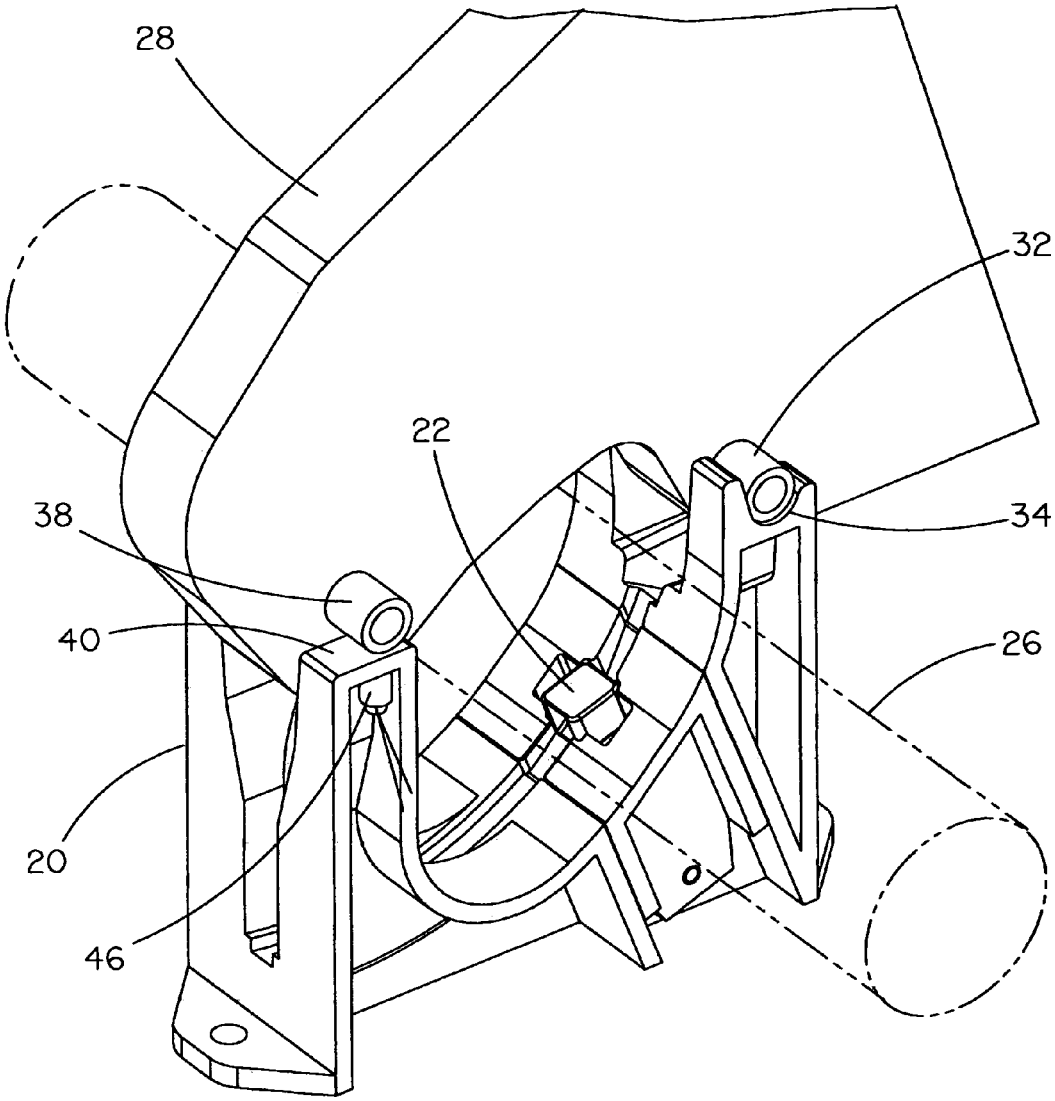
FIG. 4 is a front perspective view of the harness board fixture of FIG. 3, after the cable tie tool has been positioned therein.
Figure 5:
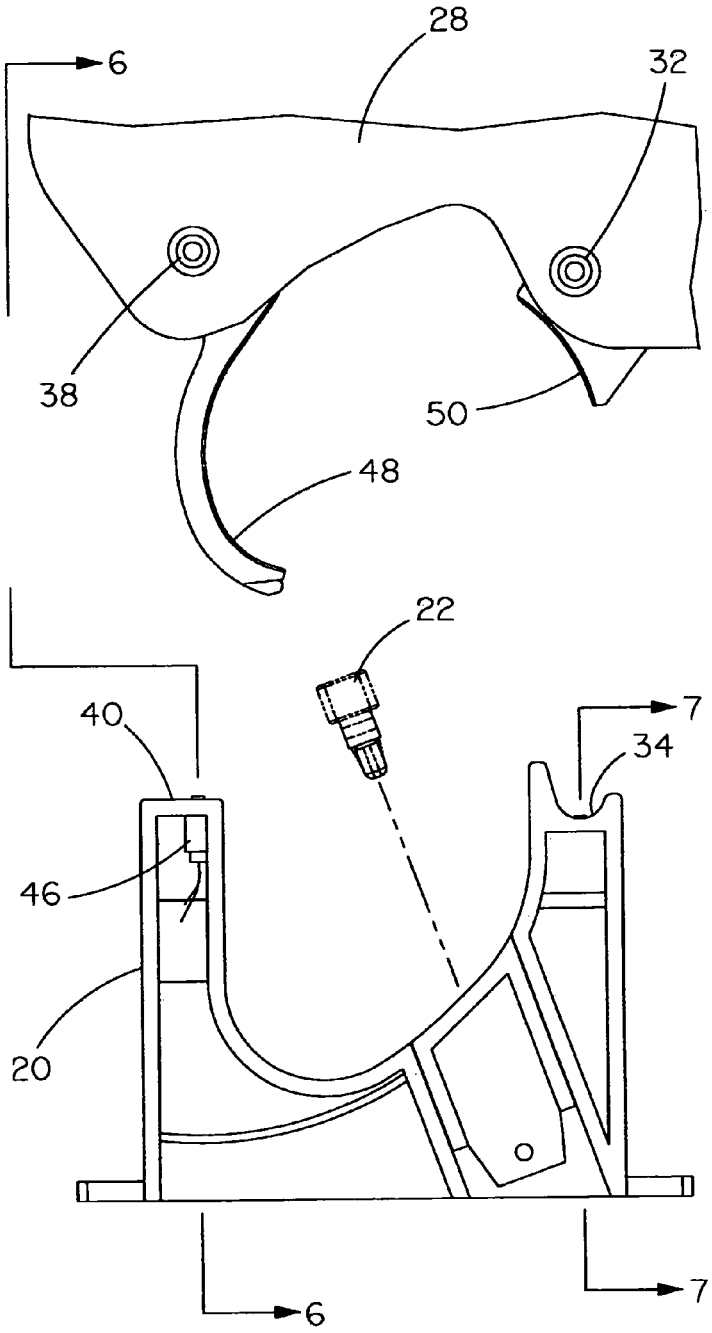
FIG. 5 is an exploded front view of the harness board fixture of FIG. 3, with the wire bundle removed.
Figure 6:
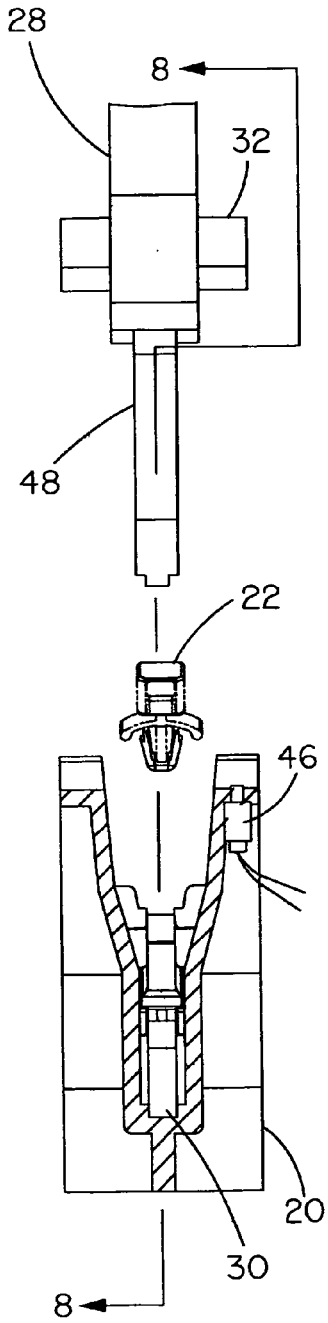
FIG. 6 is a cross-sectional view taken along lines 6-6 of FIG. 5.
Figure 15:
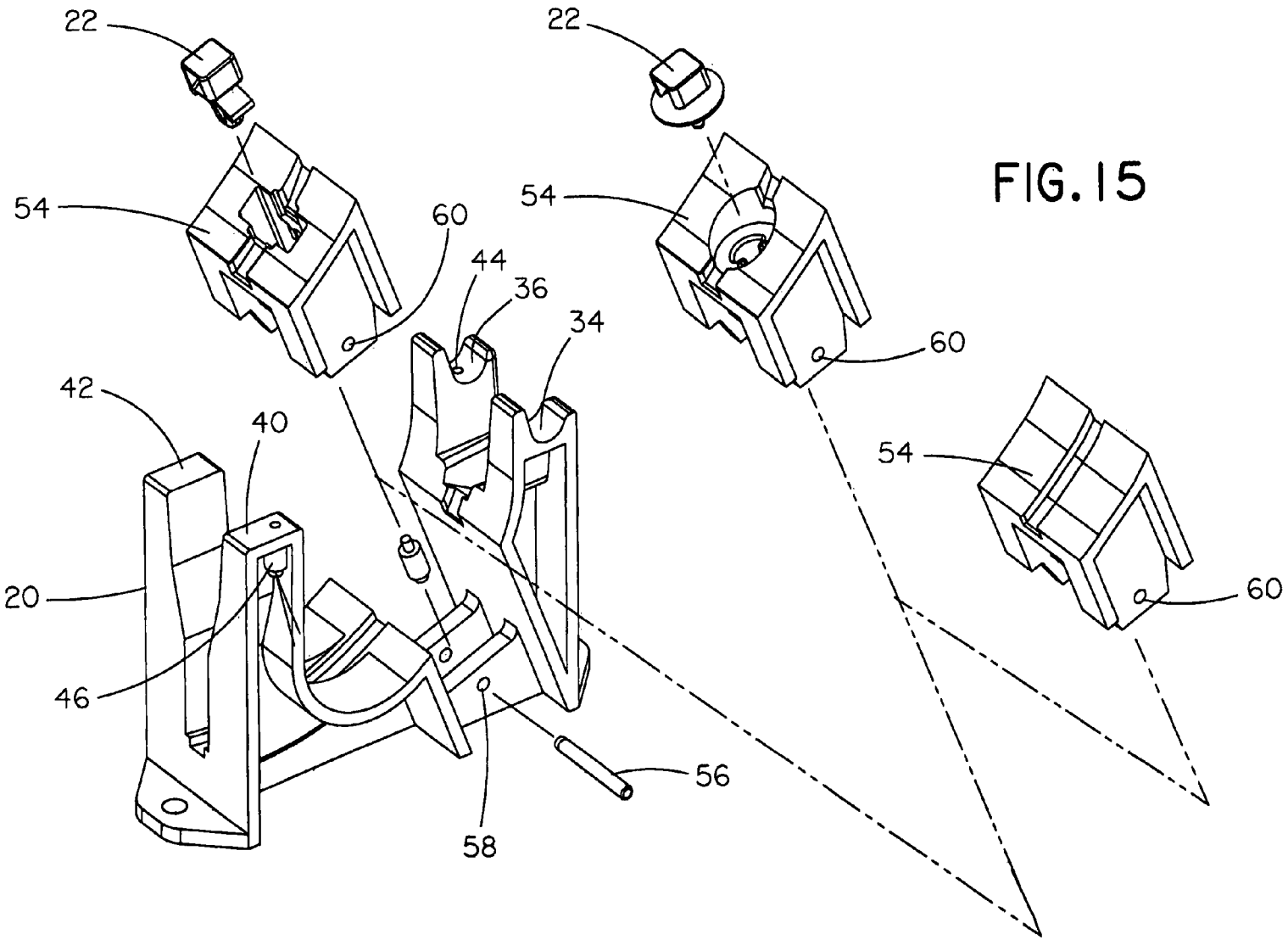
FIG. 15 is an exploded front perspective view of various harness board fixtures according to the present invention.

In operation, push mount 22 is releasably inserted into harness board fixture 20, as shown in FIG. 1. As best shown in FIG. 15, push mount 22 is releasably received within a recessed cavity and retained by retention latches. As shown in FIGS. 8-13, sensor 30 indicates that push mount 22 is properly in place. Cable tie tool 28 is then placed in harness board fixture 20 with rear tool locating studs 32 (only one shown) securely positioned in corresponding tool locating saddles 34, 36 provided on the fixture and front tool locating studs 38 (only one shown) positioned on corresponding tool locating pads 40, 42 provided on the fixture. This precisely locates the tool relative to the fixture, with tool locating saddles 34, 36 substantially constraining fore and aft movement of tool 28 as shown in FIG. 4. Preferably, at least one surface defining saddles 34, 36 is angled, allowing rough initial placement of the tool and guiding of the tool 28 to a precise mounting alignment.

Figure 7:
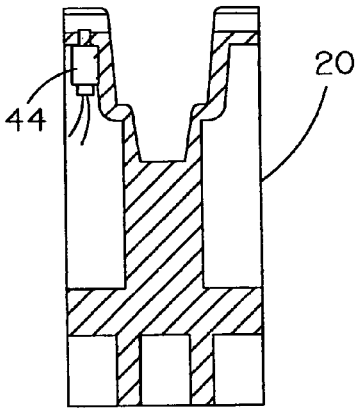
FIG. 7 is a cross-sectional view taken along lines 7-7 of FIG. 5.
Figure 8:
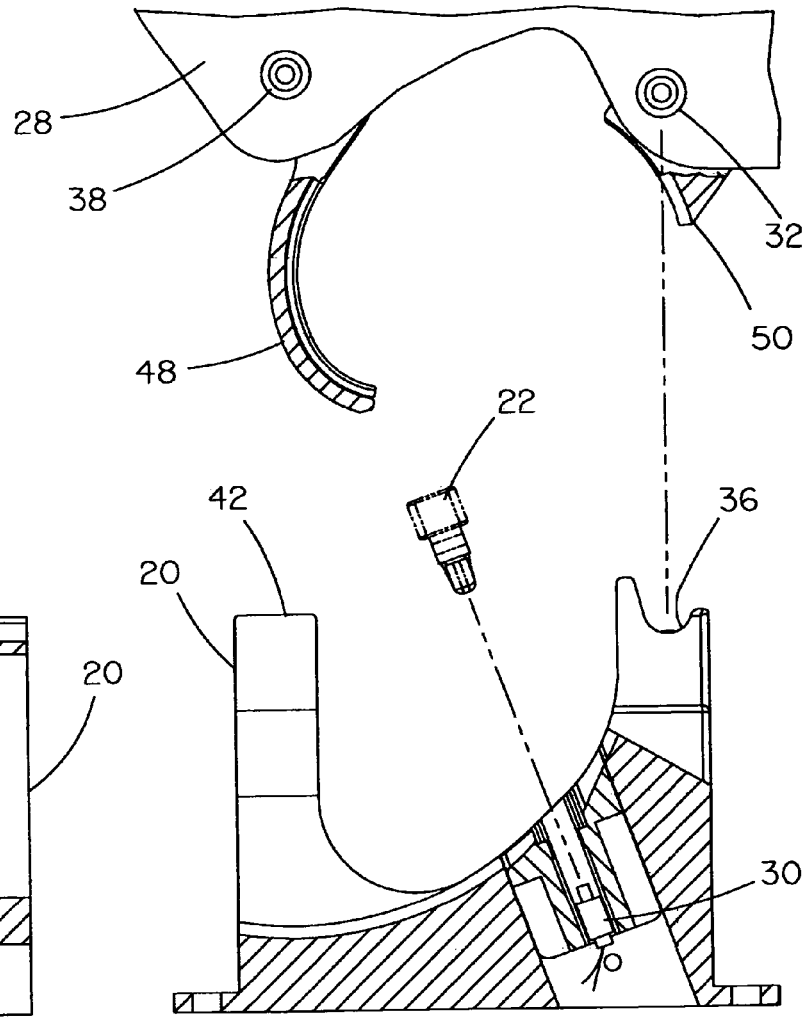
FIG. 8 is a cross-sectional view taken along lines 8-8 of FIG. 6.
Figure 9:
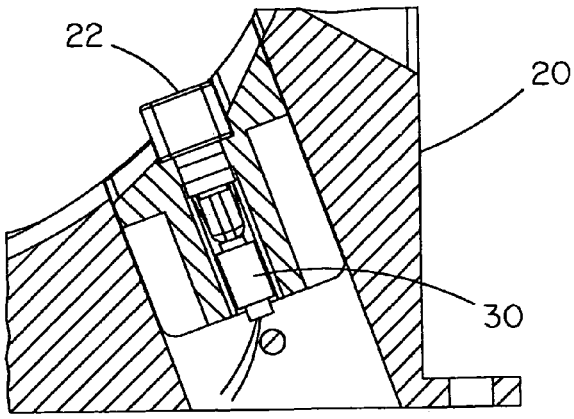
FIG. 9 is an enlarged front view of the harness board fixture of FIG. 8.
Figure 10:
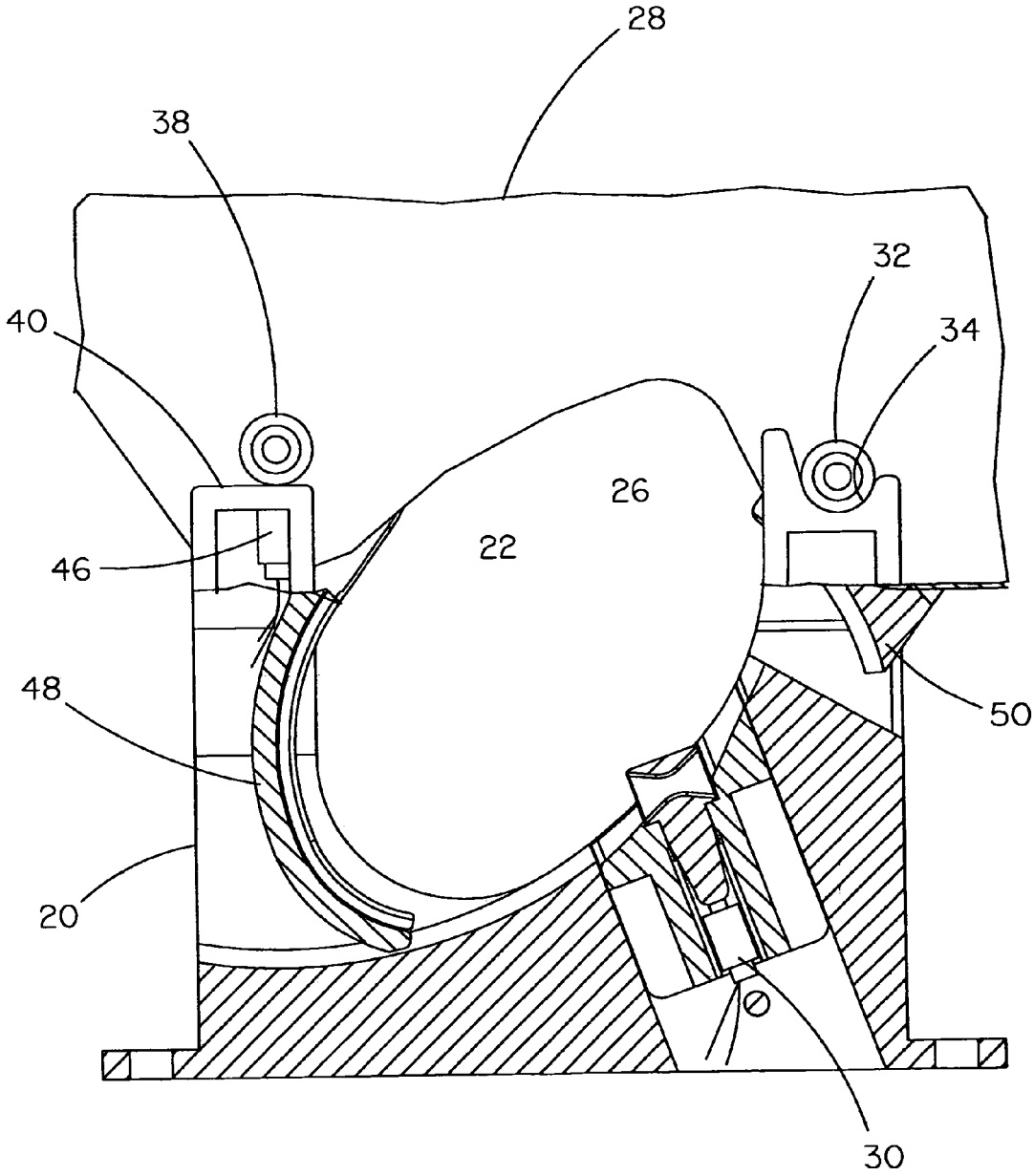
FIG. 10 is a front view of the harness board fixture of FIG. 9, showing the wire bundle and cable tie tool positioned therein.

As best seen in FIGS. 7 and 10, once tool locating studs 32, 38 engage tool locating saddles 34, 36 and tool locating pads 40, 42, respectively, tool locating studs 32, 38 activate sensors 44, 46, respectively, indicating that cable tie tool 28 is in proper position to apply cable tie 24 with push mount 22. Sensors 30, 44, and 46 may be programmed to automatically trigger cable tie tool 28 when push mount 22 and cable tie tool 28 are properly in place, or simply enable the trigger of cable tie tool 28 for manual operation. The lead wires of sensors 44, 46 can be connected to the dispenser parallel port of cable tie tool 28, which is provided for external remote control, or to the dispenser serial port, in which case a multiplexing circuit would be required.

Figure 11:
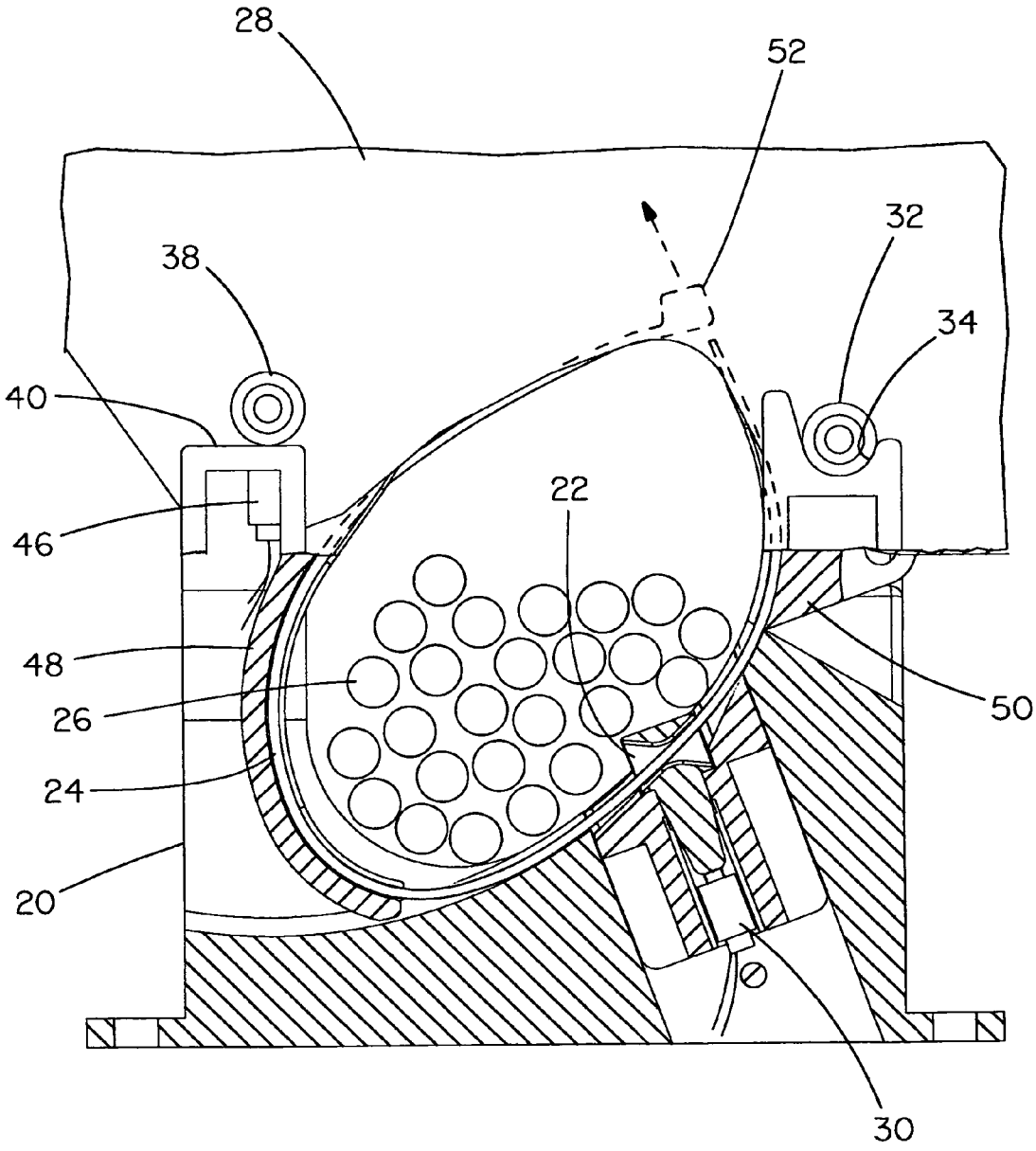
FIG. 11 is a front view of the harness board fixture of FIG. 10, after the cable tie tool has been actuated.
Figure 12:
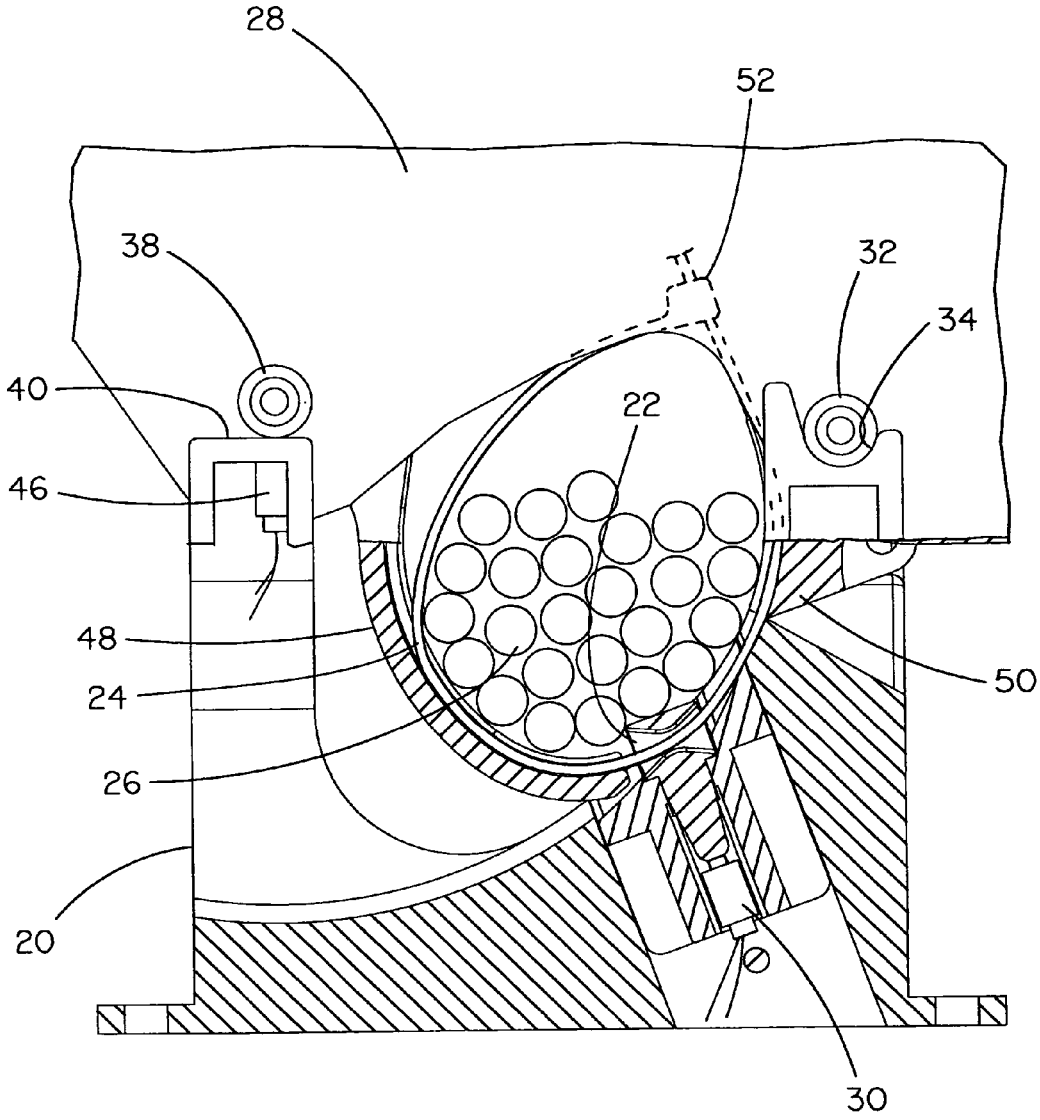
FIG. 12 is a front view of the harness board fixture of FIG. 10, showing the cable tie threaded.
Figure 13:
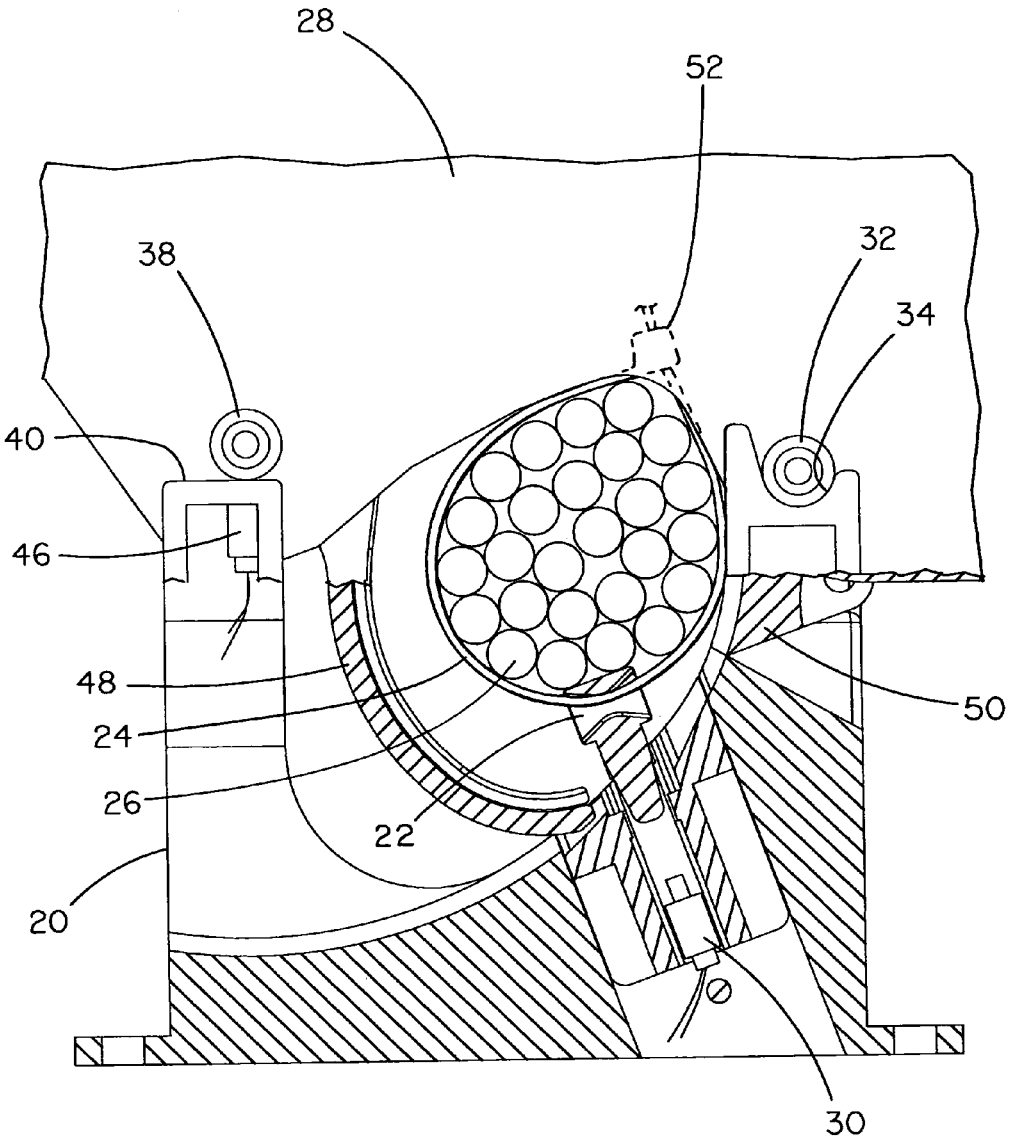
FIG. 13 is a front view of the harness board fixture of FIG. 10, showing the push mount being removed from the harness board fixture.
Figure 14:
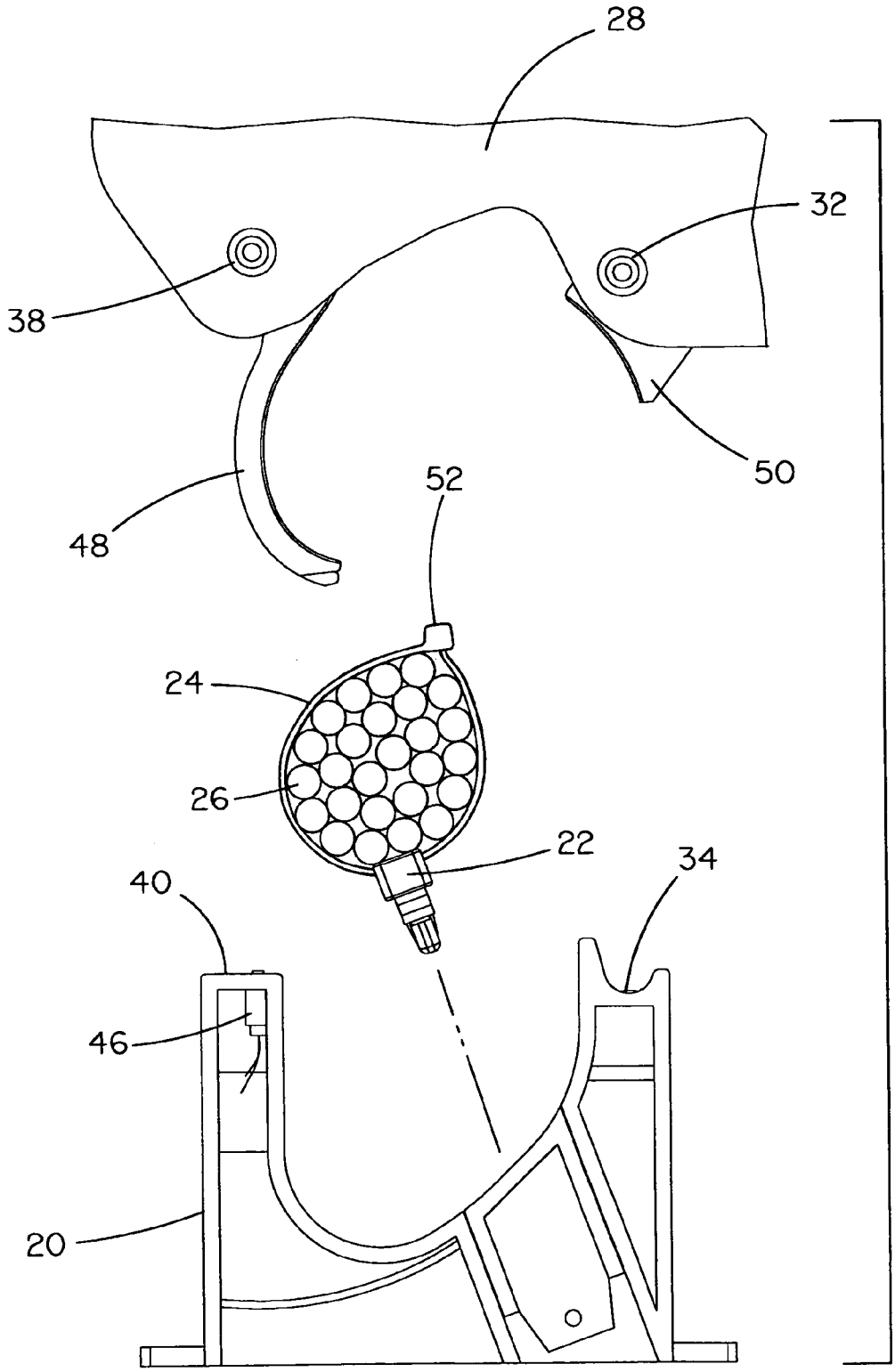
FIG. 14 is an exploded view of the harness board fixture of FIG. 10, after the push mount has been removed from the harness board fixture.

As best seen in FIG. 11, once cable tie tool 28 has been actuated, cable tie 24 is sent around front jaw 48 and rear jaw 50 and through head 52 of cable tie 24. Front jaw 48 of cable tie tool 28 then rotates, threading cable tie 24 through head 52 as shown in FIG. 12. Cable tie 24 is tensioned and cut off, pulling push mount 22 out of harness board fixture 20, as best seen in FIG. 13. When push mount 22 is removed from harness board fixture 20, sensor 30 is no longer activated, indicating that wire bundle 26 is completely secured (see FIG. 14).

Different styles of push mounts can be accommodated by having snap-in adapters to hold the different sized or shaped push mounts. A wing push mount 22 is illustrated in FIGS. 1-14. However, an umbrella push mount 22 may also be used, as shown in FIG. 15. As best seen in FIG. 15, an adapter 54 may be positioned within harness board fixture 20, and a pin 56 may be inserted through harness board fixture mounting holes 58 and adapter mounting holes 60 to secure adapter 54 within harness board fixture 20. It is likewise contemplated that other fastening means may be utilized to secure adapter 54 within harness board fixture 20. Moreover, it is likewise contemplated that a blank adapter 54 may be utilized to apply a cable tie without a push mount.

FIGS. 16-21 illustrate a second embodiment of a harness board fixture 100 that mountably receives an automatic cable tie tool 200. The harness board fixture 100 may mountably receive a push mount 300. A cable tie 500 (FIGS. 19-20) is applied through push mount 300 and around a wire bundle 400 using automatic cable tie tool 200. Harness board fixture 100 may be mounted onto a suitable work surface (unshown) and useful in the fabrication of wire harnesses used, for example, in the automotive, appliance and aerospace industries.

Figure 16:
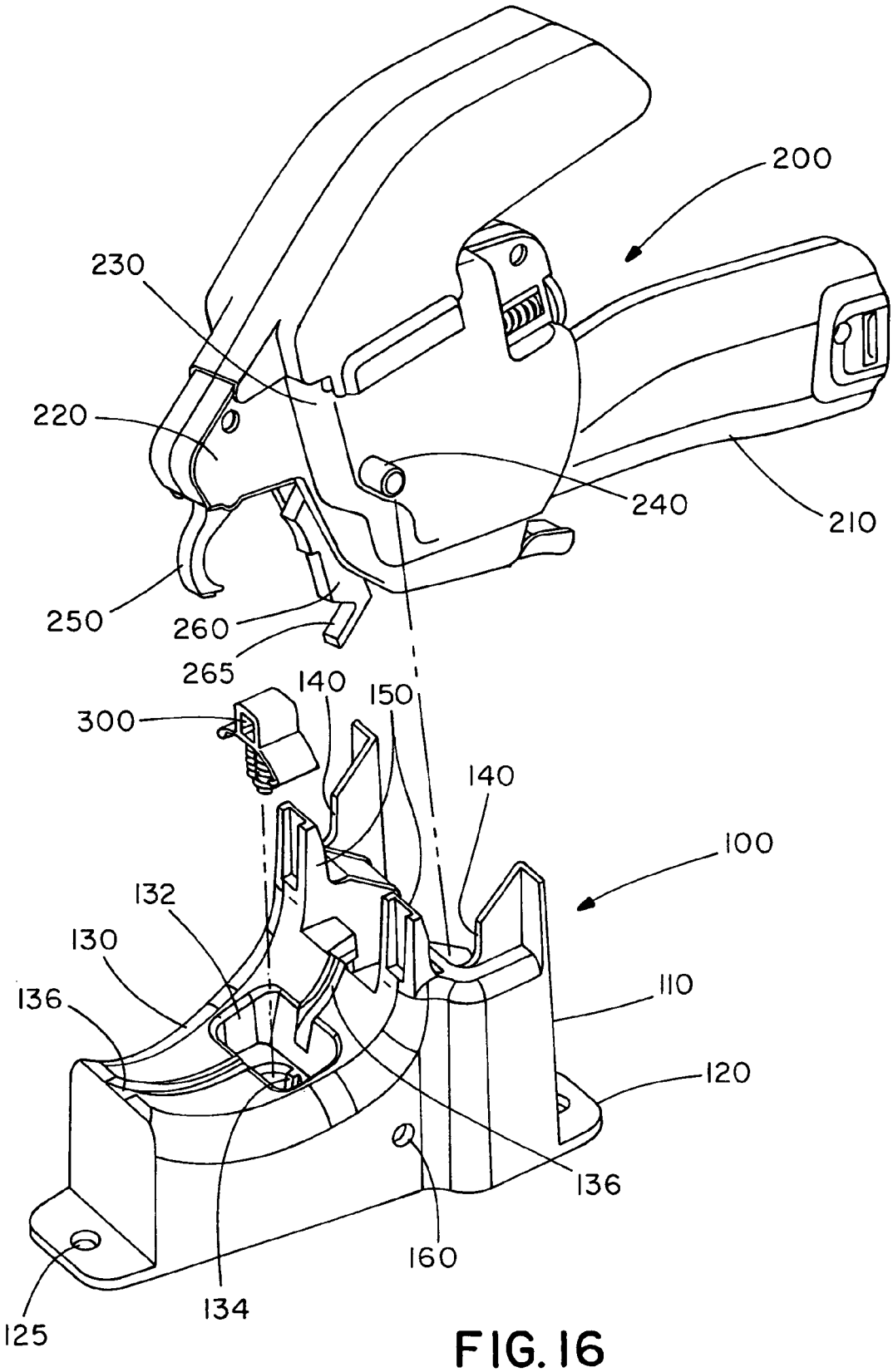
FIG. 16 is a front perspective view of a second embodiment of a harness board fixture for receiving a wire bundle positioned therein and a cable tie tool located thereabove prior to mounting on the fixture.
Figure 19:
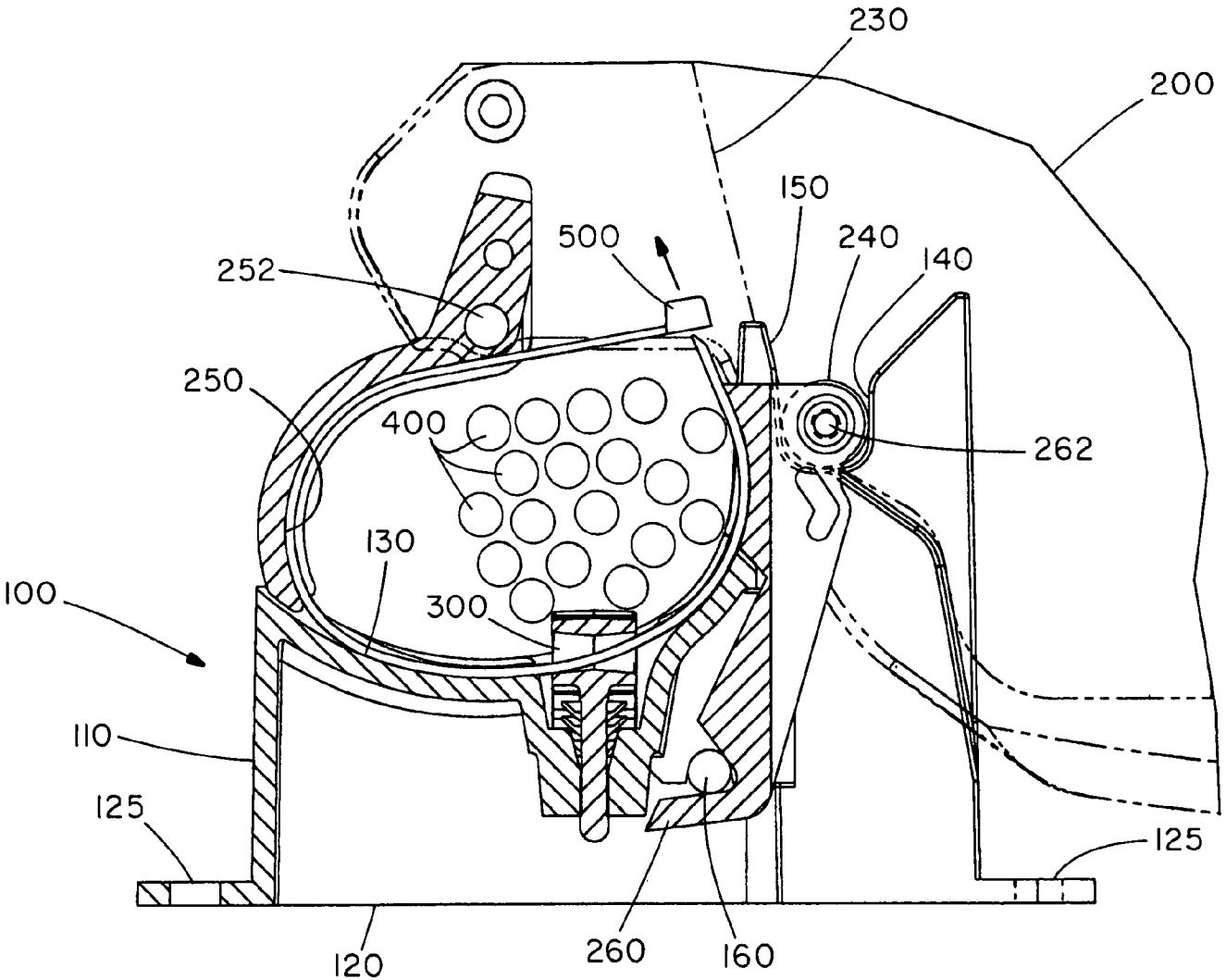
FIG. 19 is a side view of the harness board fixture of FIG. 16, showing the cable tie tool mountably positioned thereon in an initial open jaw position that partially encircles a wire bundle positioned on the harness board fixture.

As shown in FIG. 16, harness board fixture 100 includes a main body 110 and a base 120 having mounting apertures 125 for mounting the fixture to a support surface, such as a vertically or horizontally-oriented work surface. Fixture 100 also includes an arcuate wire bundle support surface 130 and automated cable tie installation tool mounting features, including a pair of tool locating saddles 140, a pair of tool locating pads 150, and a horizontally extending mounting pin 160 located generally below saddles 140 and pads 150. Wire bundle support surface 130 preferably includes a push mount receiving cavity 132 and push mount retention latches 134 for receiving and temporarily retaining a push mount 300 (FIG. 19). Cable support surface 130 also preferably includes a recessed channel 136 sized to receive and guide a cable tie during cable tie installation as will be described later.

Figure 17:
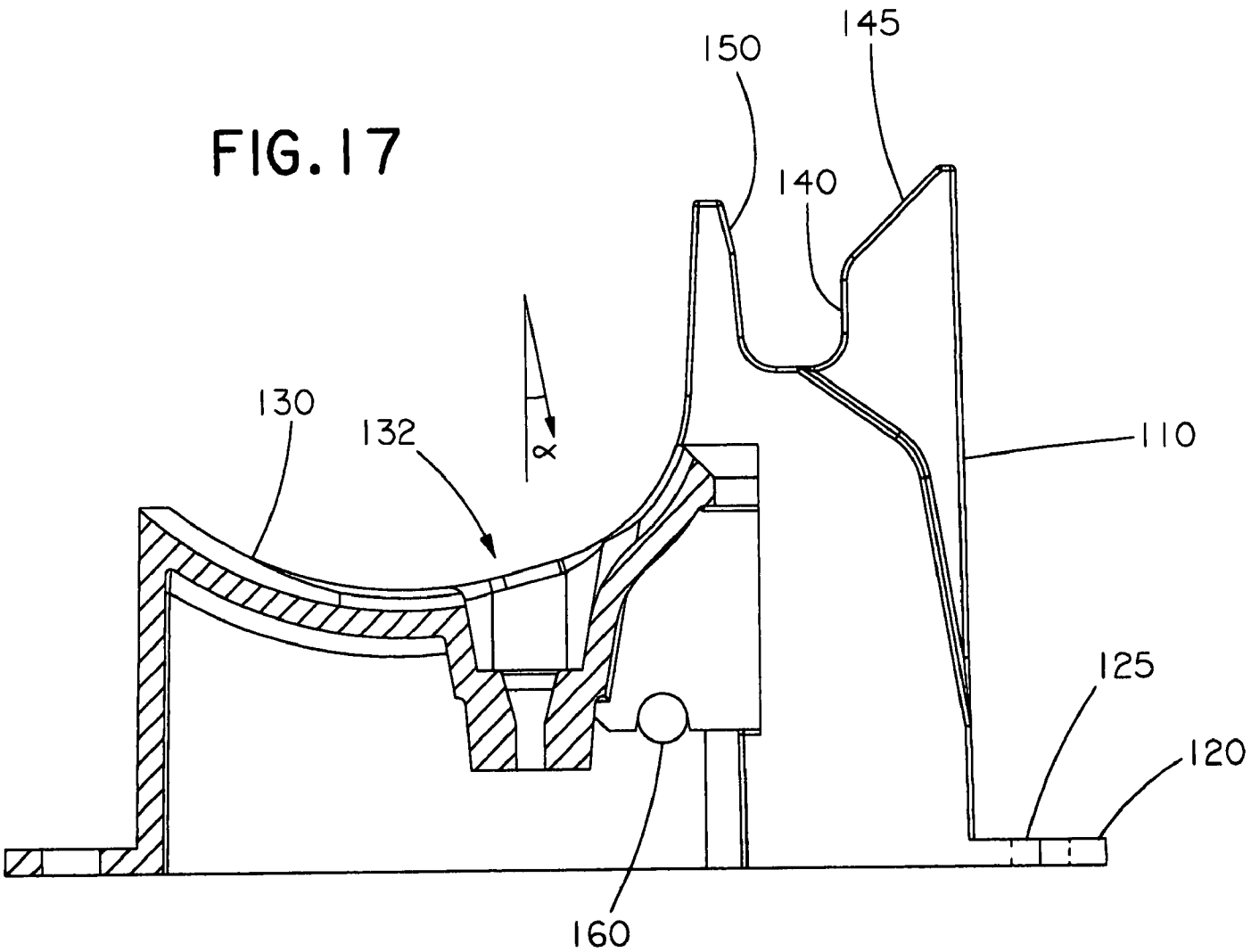
FIG. 17 is a side view of the harness board fixture of FIG. 16.
Figure 18:
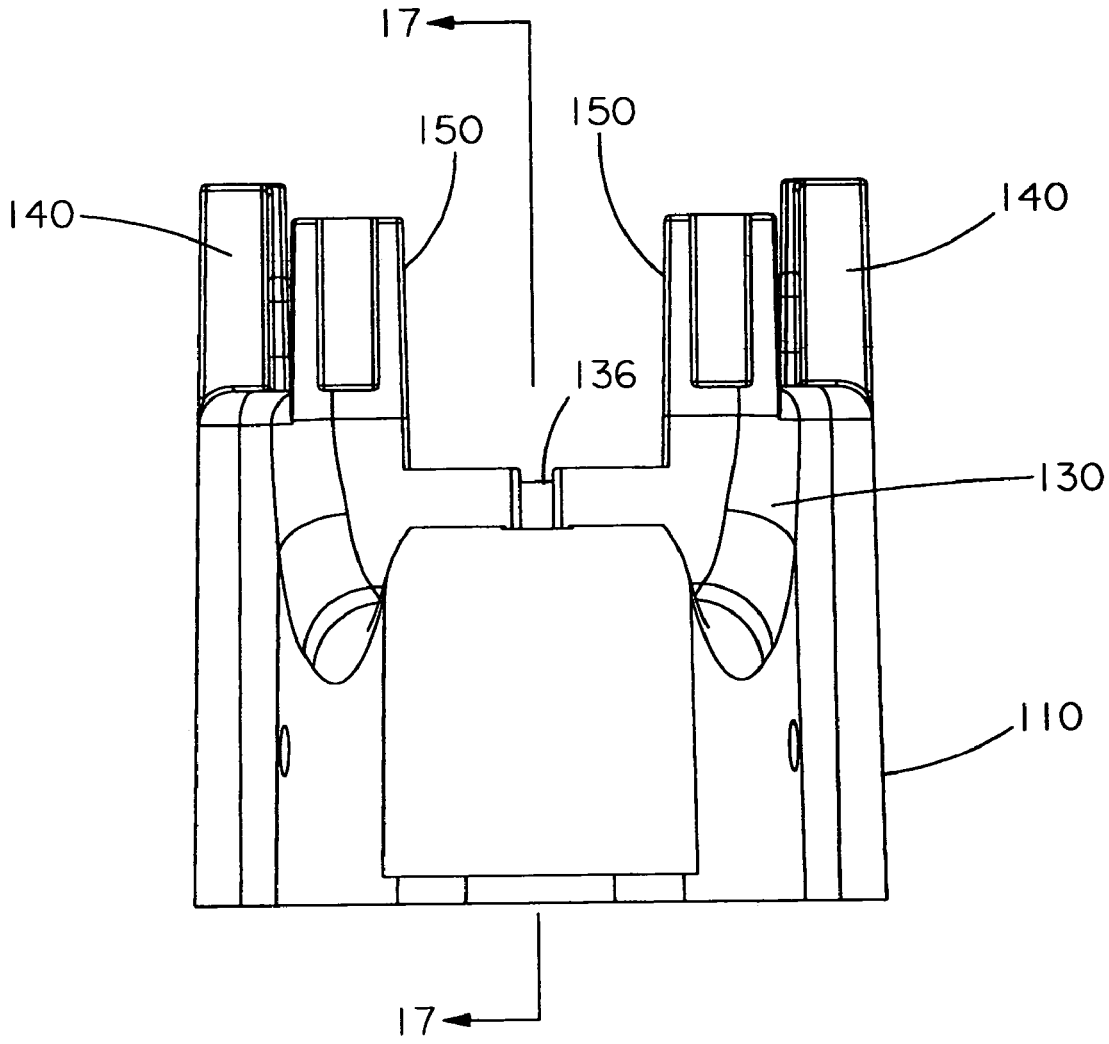
FIG. 18 is a front view of the harness board fixture of FIG. 16.

Cavity 132 is preferably provided to support the push mount 300 in a substantially vertical orientation, perpendicular to base 120 of fixture 100. There is an ease of installation if the push mount is installed vertically. However, the push mount needs to be oriented correctly relative to the automated cable tie installation tool 200. The exact orientation depends on several factors, including the tool's jaw and handle design. Preferably, the tool needs to be oriented so that the handle does not bump onto the plywood or other base support on which the fixture is mounted. If there is sufficient height in the design, the push mount can be substantially vertically provided as shown. If there is insufficient height to prevent interference between the tool and base substrate, the fixture 100 can be mounted on standoffs to compensate for the insufficient height. Alternatively, the push mount cavity 132 can be oriented at a slight angle along support surface 130 to properly orient the push mount relative to the tool to enable proper operation of the tool 200. A typical push mount can be oriented at an angle $\alpha$ of between about 0-20° (FIG. 17).

Automated cable tie installation tool 200 includes a handle 210 connected on one end to a conventional cable tie dispenser (unshown) through a feeder hose (also unshown). A cable tie tool head 220 is provided at the other end of handle 210. Head 220 includes a pair of projecting tool locating features 230 that mate with locating pads 150 on fixture 100 and a pair of tool locating studs 240 that mate with corresponding tool locating pin saddles 140 provided on fixture 100. The backside of tool 200 is preferably a substantial mirror image of the illustrated side. Preferably, at least one of the locating features on the harness board fixture includes an angled surface that allows a rough initial placement of the tool 200 during mounting to guide the tool to a precise mounting alignment. This may include angled surface 145 on tool locating pin saddles 140 and/or an angled surface on locating pads 150 as better shown in FIG. 17.

Tool head 220 also includes structure within head 220 to feed a cable tie 500 (FIG. 19) around a wire bundle 400. To assist in defining the path of the cable tie 500, tool 200 includes a pivotal front jaw 250. Head 220 also includes a rear jaw 260. However, while prior cable tie installation tools used the rear jaw to assist in defining the path of the cable tie, this tool primarily uses the rear jaw 260 to mate the tool 200 to fixture 100 through mounting pin 160. In particular, tool 200 is positioned on fixture 100 by alignment of locating features. Upon completion, rear jaw 260 can be closed to the position shown in FIG. 19 where notch 265 securely interengages with mounting pin 160. This securely mounts the tool 200 to the fixture 100 by locking pins 240 in pin saddles 140 and locking locating surfaces 230 against locating pads 150.

Figure 20:
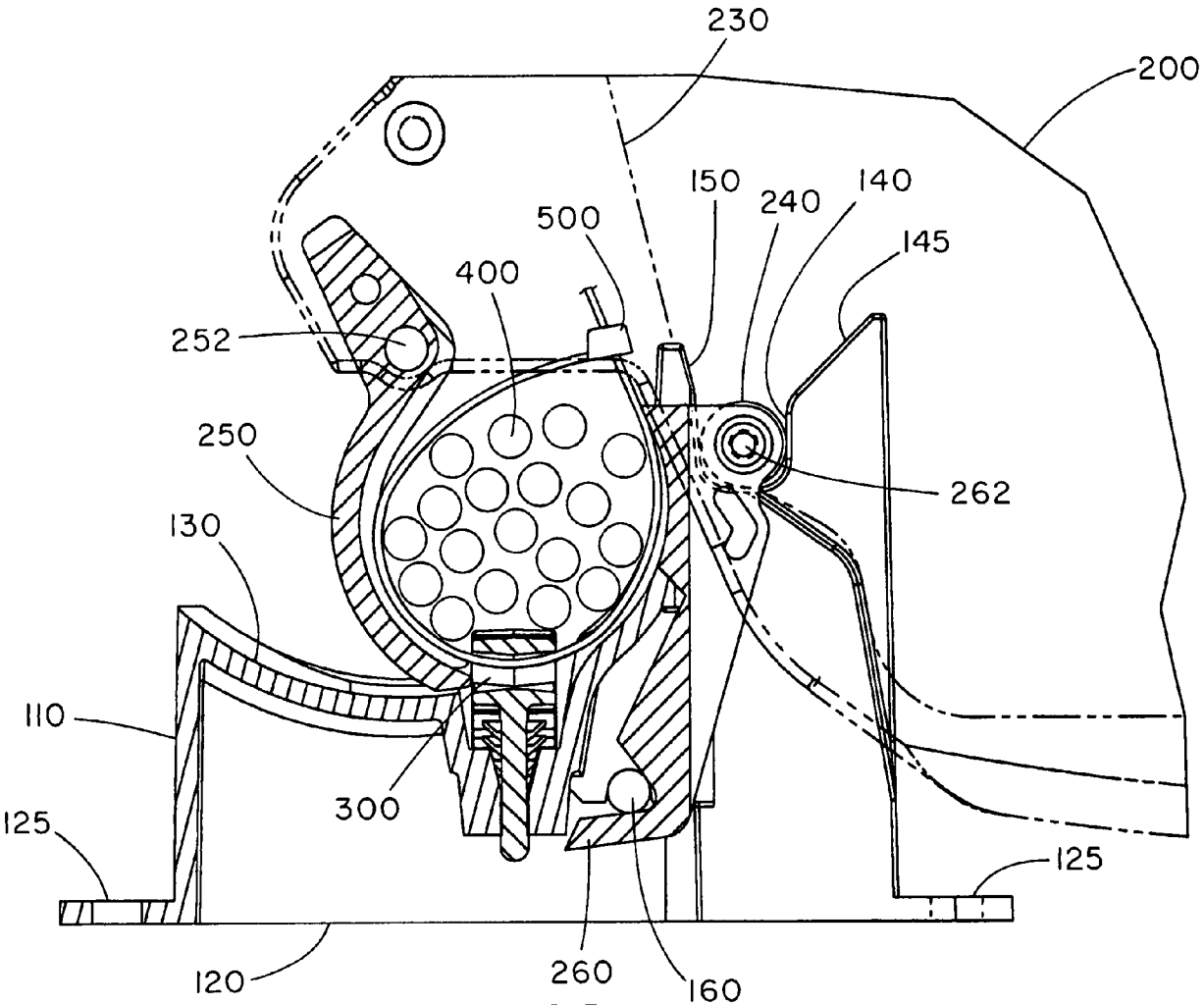
FIG. 20 is a side view of the harness board fixture of FIG. 19, showing the cable tie tool mountably positioned thereon in a closed jaw position that closely encircles the wire bundle positioned on the harness board fixture.

Operation of the cable tool 200 and harness board fixture 100 will be described with reference to FIGS. 19-20. A push mount 300 is optionally provided in push mount receiving cavity 132 and releasably supported by retention latches 134. Different styles of push mounts can be accommodated by having snap-in adapters to hold the different sized or shaped push mounts. A wing push mount 300 is illustrated. However, it is contemplated that a blank adapter may be used to apply a cable tie without a push mount.

A bundle of cable wires 400 is then initially placed in a predetermined configuration and path on one or more cable support surfaces 130 of one or more harness board fixtures 100 to form a wiring harness. A typical application for such a bundle 400 is in the making of an automobile wiring harness, but can be used to make other wire bundles. Each fixture and tool combination is preferably sized to accept a defined wire bundle maximum size. This may include, for example, a 1.5" maximum bundle diameter or a 2.0" maximum bundle diameter, which are bundled by a suitably sized cable tie. Once the bundles 400 are suitably positioned, cable tie installation tool 200 is mounted onto fixture 100 over bundle 400 by alignment of locating features as shown in FIG. 19. In this position, front jaw 250 is initially open.

Cable tool 200 is then actuated, sending a cable tie 500 into tool head 220, which advances the tie around the wire bundle 400 and through push mount 300. Movement of cable tie 500 is constrained about a path defined by the front jaw 250, which may have a recessed interior, and by arcuate guide channel 136 in cable support surface 130 sized to receive a cable tie therein. If a push mount 300 is provided, the cable tie 500 is fed through an aperture in the push mount head of push mount 300.

Front jaw 250 then rotates about pivot joint 252 to a closed position. This force threads the cable tie 500 through the cable tie head and cinches the cable tie snugly about wire bundle 400 as shown in FIG. 20. Cable tie 500 is tensioned and cut off, pulling push mount 300 out of harness board fixture 100. Upon completion, rear jaw 260 can be retracted to release tool 200 from fixture 100, allowing removal of tool 200. Then, once all necessary cable ties 500 are installed on wire bundle 400, the completed wire harness formed by wire bundle 400 can be removed from the harness board fixtures 100.

As shown, harness board fixture 100 has access to wire bundle support surface 130 from multiple sides, such as either side, the top or front side, allowing improved flexibility in positioning of wire bundles 400 onto and away from support surface 130. This is because all of the cable tie installation tool locating features may be provided for on one side of the fixture 100 as shown, allowing for the opposite side, the front, to be open and free from obstruction. Thus, a wire bundle entrance and exit path may be provided on the front side of the fixture to allow removal or entry of the wire bundle. Moreover, by providing a cable guide surface 136 that continuously extends from the front jaw 250 to a position closely adjacent a head of the cable tie, the need for a cable tie guide using the rear jaw is eliminated, allowing the rear jaw to be used primarily for engagement with mounting pin 160.

Figure 21:
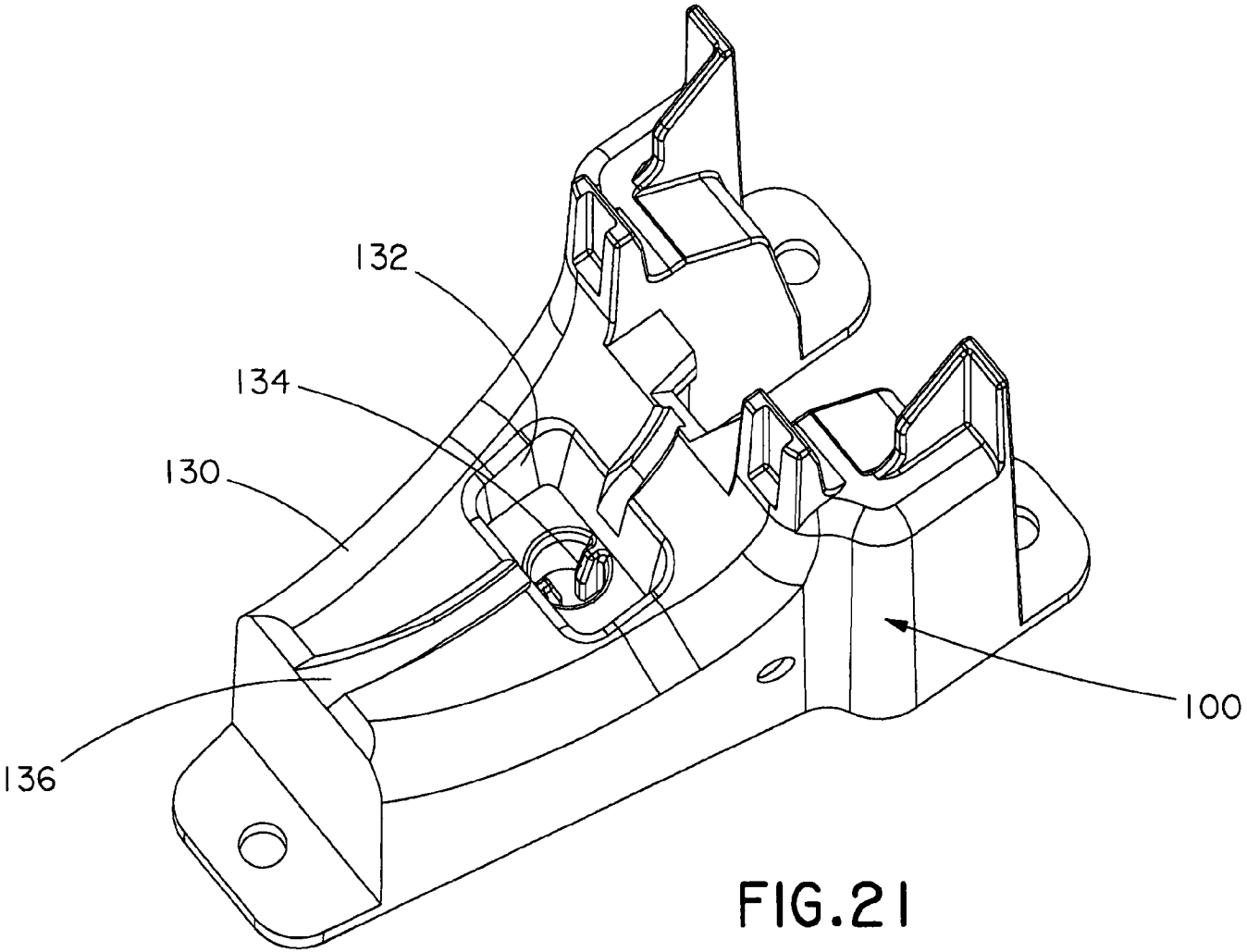
FIG. 21 is a partial front perspective view of a push mount receiving cavity of the harness board fixture of FIG. 16.
Figure 22:
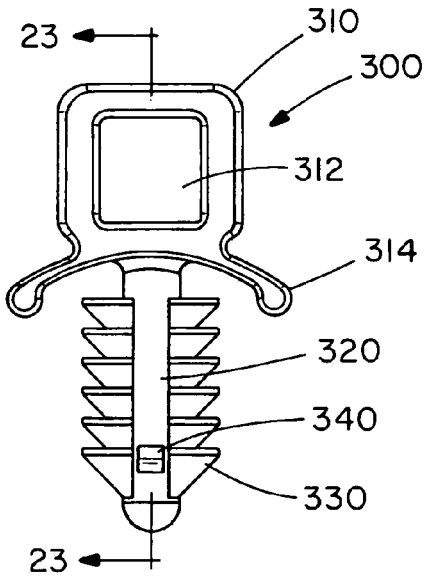
FIG. 22 is a side view of an exemplary push mount for use with the harness board fixture of FIG. 16.
Figure 23:
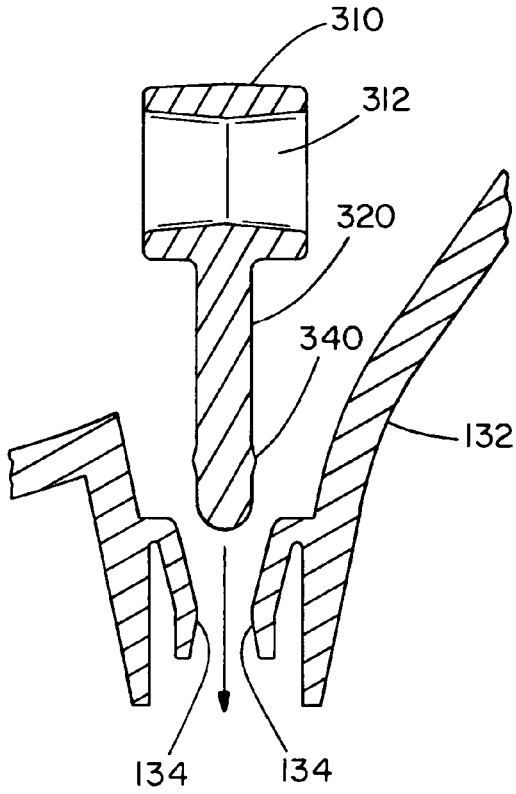
FIG. 23 is a partial cross-sectional view taken along lines 23-23 of FIG. 22, showing the push mount of FIG. 22 being inserted into the push mount receiving cavity of the harness board fixture of FIG. 16.
Figure 24:
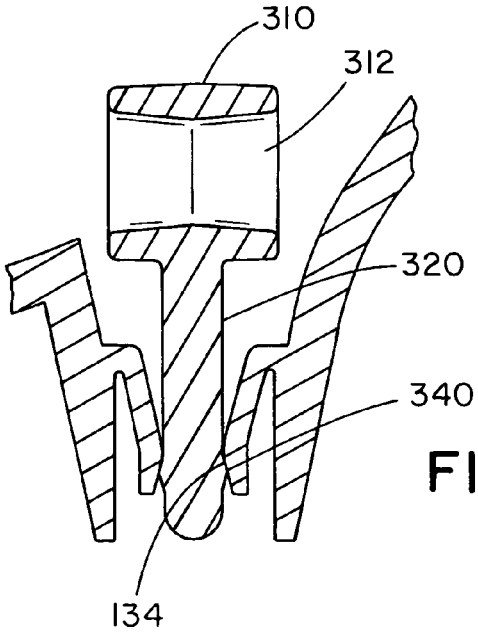
FIG. 24 is a partial cross-sectional view of FIG. 22, showing the push mount in a fully installed position where it is flexibly retained within the push mount receiving cavity.
Figure 25:
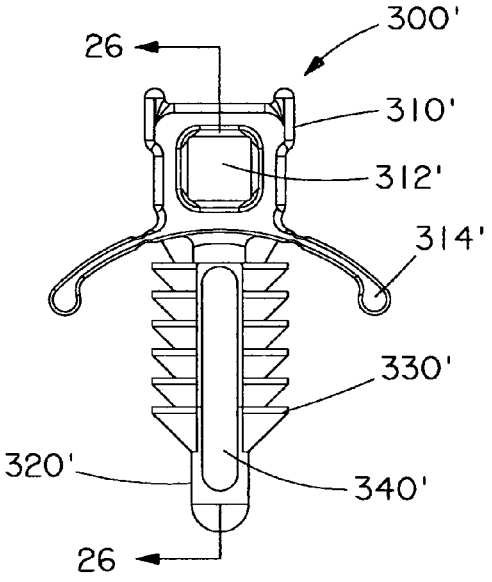
FIG. 25 is a side view of an alternative push mount for use with the harness board fixture of FIG. 16.
Figure 26:
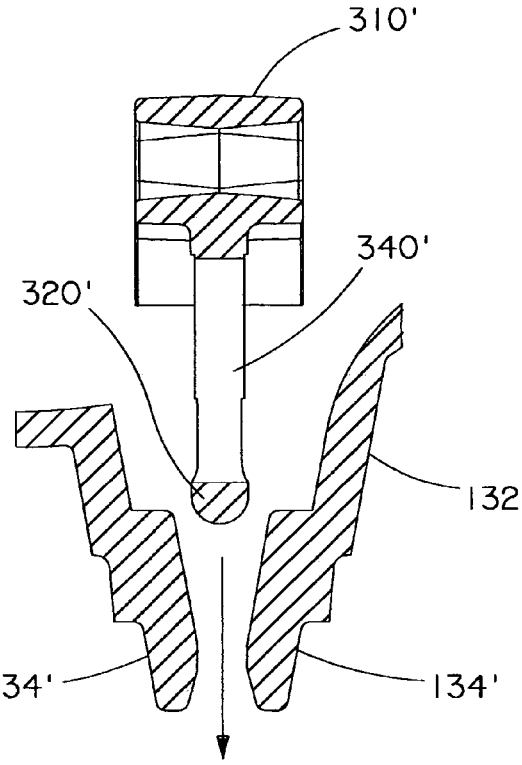
FIG. 26 is a partial cross-sectional view taken along lines 26-26 of FIG. 25, showing the push mount of FIG. 25 being inserted into an alternative push mount receiving cavity in the harness board fixture of FIG. 16.
Figure 27:
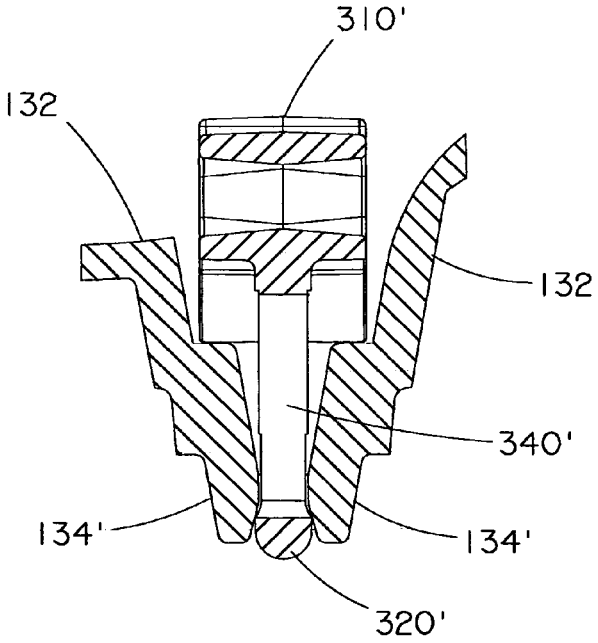
FIG. 27 is a partial cross-sectional view of FIG. 25, showing the push mount in a fully installed position where it is retained within the push mount receiving cavity.

Various push mounts and push mount retention structures for use with fixture 100 will be described with reference to FIGS. 21-27. FIG. 21 shows a partial close-up showing cable support surface 130, including push mount cavity 132 defined by recessed walls, push mount retention latches 134 that mate with push mount 300, and cable tie groove 136. FIGS. 22-24 illustrate a first exemplary mount and FIGS. 25-27 illustrate a second exemplary mount.

Push mount 300 in FIG. 22 includes a push mount head 310 having a square central aperture 312 extending therethrough and a wing-shaped base 314. A stem 320 extends perpendicular to aperture 312 and includes a plurality of one-way locking ribs 330, as known in the art, that are preferably angled to allow for easy insertion into a retaining hole (unshown), but resist removal from the hole once inserted. In this embodiment, push mount 300 also includes a retention element 340 in the form of an outward protrusion on opposite sides of stem 320.

Push mount receiving cavity 132, as best shown in FIG. 23, includes retention latches 134. Latches 134 are flexibly mounted to walls of cavity 132, such as by cantilever mounting of one end of the latch to the wall. Due to the elastic nature of the latch when formed from a suitably sized plastic or metal, the latches 134 will yield during entry of push mount 300 into the cavity (FIG. 23). Additionally, the latches 134 will resiliently retain push mount 300 once fully inserted (FIG. 24) by interengagement of the retention element 340 with latches 134. However, upon application of sufficient upward force, push mount 300 can be released from latches 134.

The use of flexible latches has various advantages over conventional push mount retaining structures. In the past, push mounts were held by friction fit within a suitably sized opening in the bottom wall of cavity 132. Although this design works for a while, because of the typical repeated use of the harness board fixtures to assemble numerous wire harnesses, the bottom opening in the cavity eventually increases from wear to a point where there is no longer a friction fit. Because harness board fixtures are often mounted on vertical walls, it is possible that loosely fitted push mounts will fall out due to forces of gravity or the like. This can complicate or slow down the assembly process and may result in the need to install a new fixture.

The flexible latches 134 are capable of repeated use without experiencing the same wear problem. Additionally, rather than relying on a friction fit, the latches 134 can yield during insertion to reduce insertion force yet sufficiently apply a biasing force or snap-fit to the push mount 300 to retain the push mount in the fixture.

FIGS. 25-27 show an alternative embodiment. In this embodiment, push mount 300' includes a similar push mount head 310', aperture 312' and wing-shaped base 314'. However, stem 320' includes locking ribs 330' and a retention element 340' in the form of an elongated cavity that extends down a portion of stem 320'. The cavity does not extend entirely to a remote end of stem 320'. Push mount receiving cavity 132 in this embodiment includes retention latches 134'. Latches 134' similarly yield to allow insertion of stem 320'. However, once stem 320' is sufficiently inserted, latches 134' are urged at least slightly into retention cavity 340', which slidably retains push mount 300 from removal. Although shown to have an elongated form, allowing limited vertical movement, retention cavity 340' can be made shorter to securely retain push mount 300 in a fixed vertical position.

Figure 28:
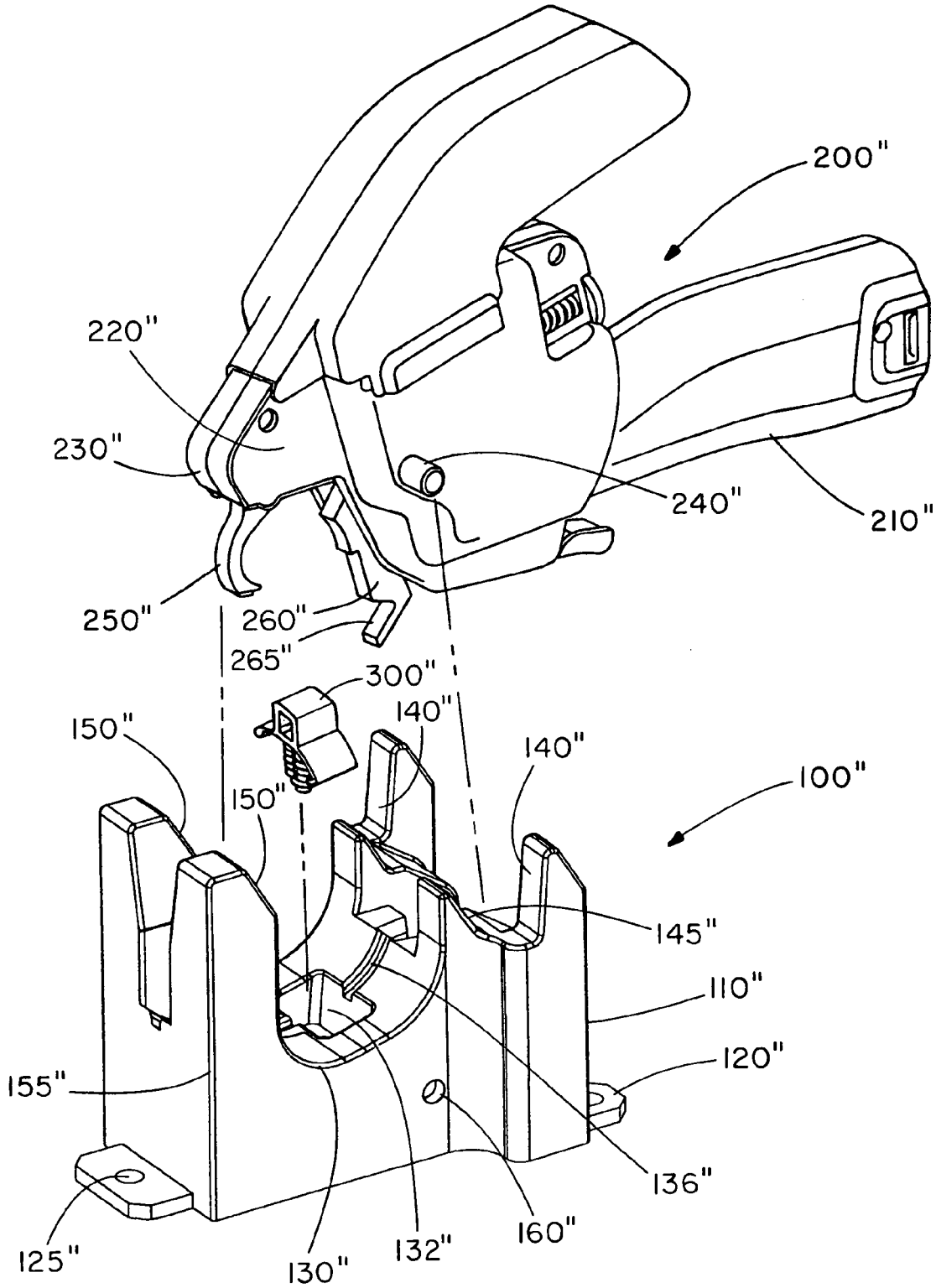
FIG. 28 is a front perspective view of a further embodiment of a harness board fixture for receiving a wire bundle positioned therein and a cable tie tool located thereabove prior to mounting on the fixture.
Figure 29:
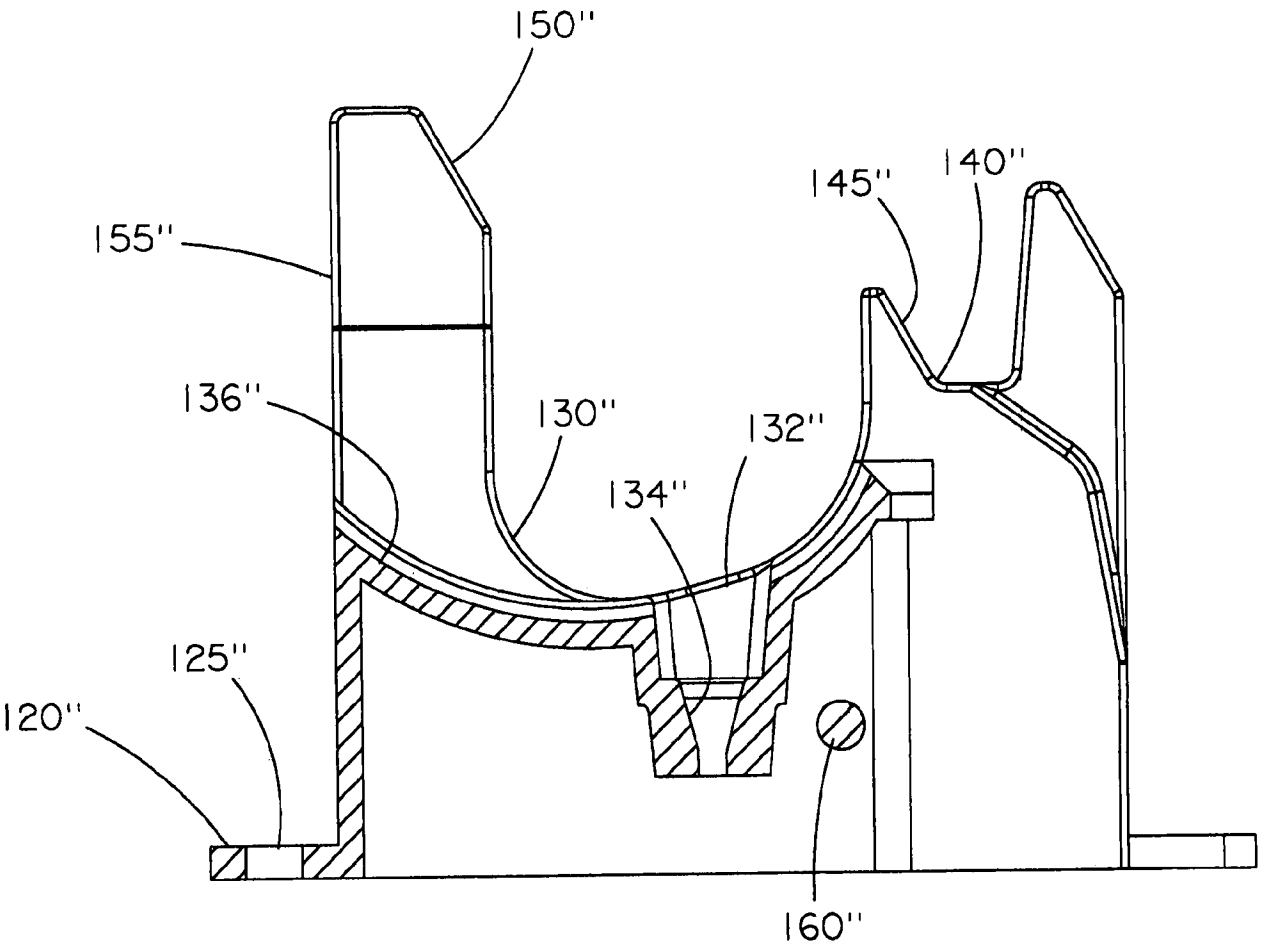
FIG. 29 is a side view of the harness board fixture of FIG. 28.
Figure 30:
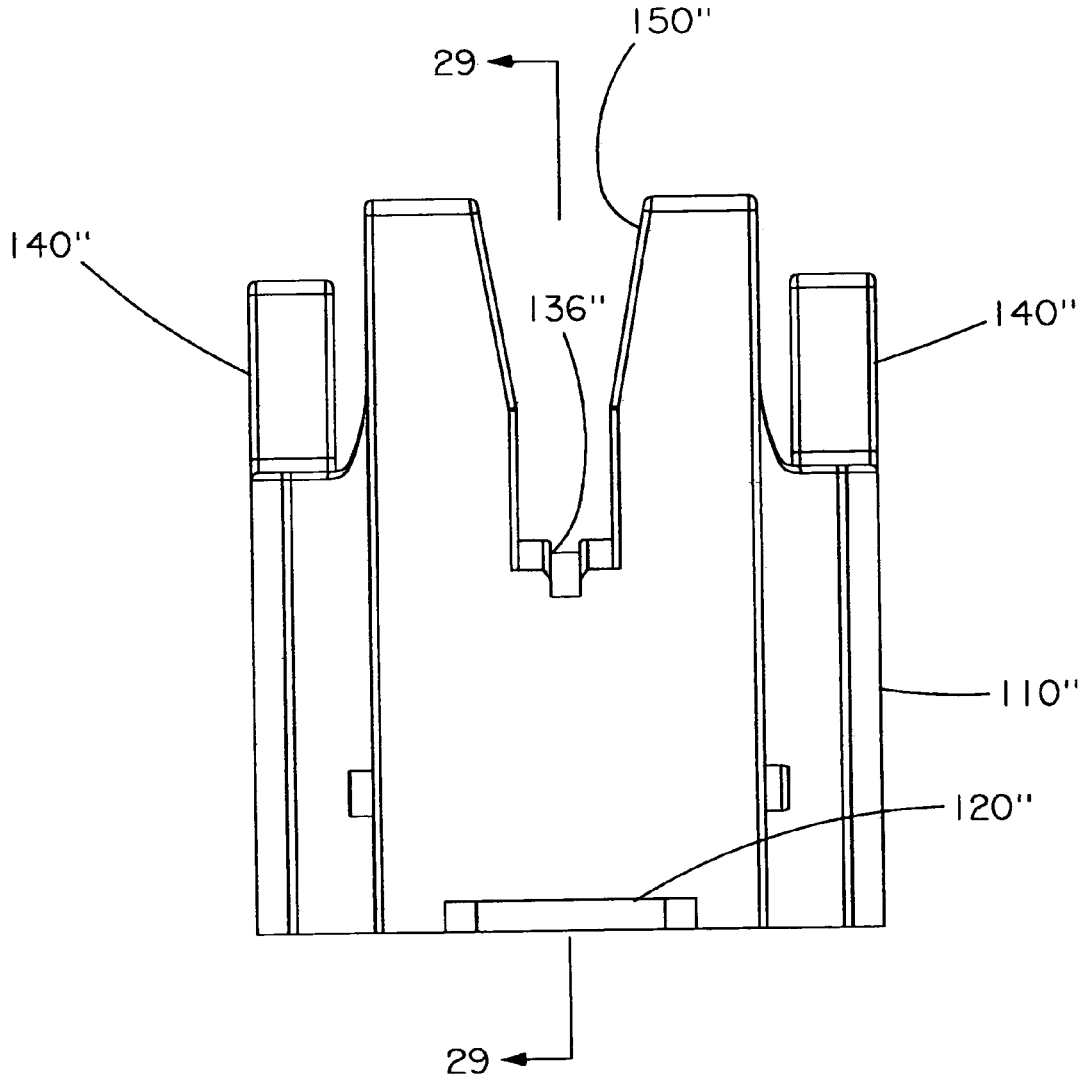
FIG. 30 is a front view of the harness board fixture of FIG. 28.

FIGS. 28-31 illustrate a further embodiment of a harness board fixture 100". In FIG. 28, harness board fixture 100" includes a main body 110" and a base 120" having mounting apertures 125". Fixture 100" also includes an arcuate cable support surface 130" and automated cable tie installation tool mounting features. The mounting features include a pair of tool locating pin saddles 140", a pair of tool locating pads 150", and a horizontally extending mounting pin 160" located generally below saddles 140". Cable support surface 130", as in the previous embodiment, preferably includes a push mount receiving cavity 132" and push mount retention latches 134" for receiving and temporarily retaining a push mount 300". Cavity 132" is preferably provided to support the push mount 300" in a substantially vertical orientation, perpendicular to base 120" of fixture 100". Cable support surfaces 130" also preferably include a recessed channel 136" sized to receive and guide a cable tie during cable tie installation. However, in this embodiment, locating pads 150" and pin saddles 140" are provided on opposite sides of the fixture. As shown in FIG. 29, locating pads 150" are provided on the left side of cable support surface 130" on a top portion of upstanding arms 155". As in the prior embodiment, pin saddles 140" are provided on the right side of cable support surface 130" substantially above mounting pin 160". Additionally, angled locating surfaces 145" can be provided to assist in properly aligning the tool to pin saddles 140".

In FIG. 28, tool 200" may be the same as tool 200 shown in FIG. 1, or may have a slightly different configuration. As shown, automated cable tie installation tool 200" includes a handle 210" and cable tie tool head 220" having tool locating surfaces 230", tool locating pins 240", front jaw 250", and rear jaw 260". Elements 240", 250" and 260" remain as in the previous embodiment. However, in this embodiment, different surfaces act as tool locating surfaces 230" that mate with modified locating pads 150" on fixture 100". In this embodiment, a front surface of tool 200" is used as a tool locating surface 230". Preferably, at least one of the tool locating features on the harness board fixture 100" includes an angled surface that allow a rough initial placement of the tool 200" during mounting to be guided to a precise mounting alignment. This may include angled surface 145" on tool locating pin saddles 140" and/or an angled surface on locating pads 150" as better shown in FIG. 28.

Figure 31:
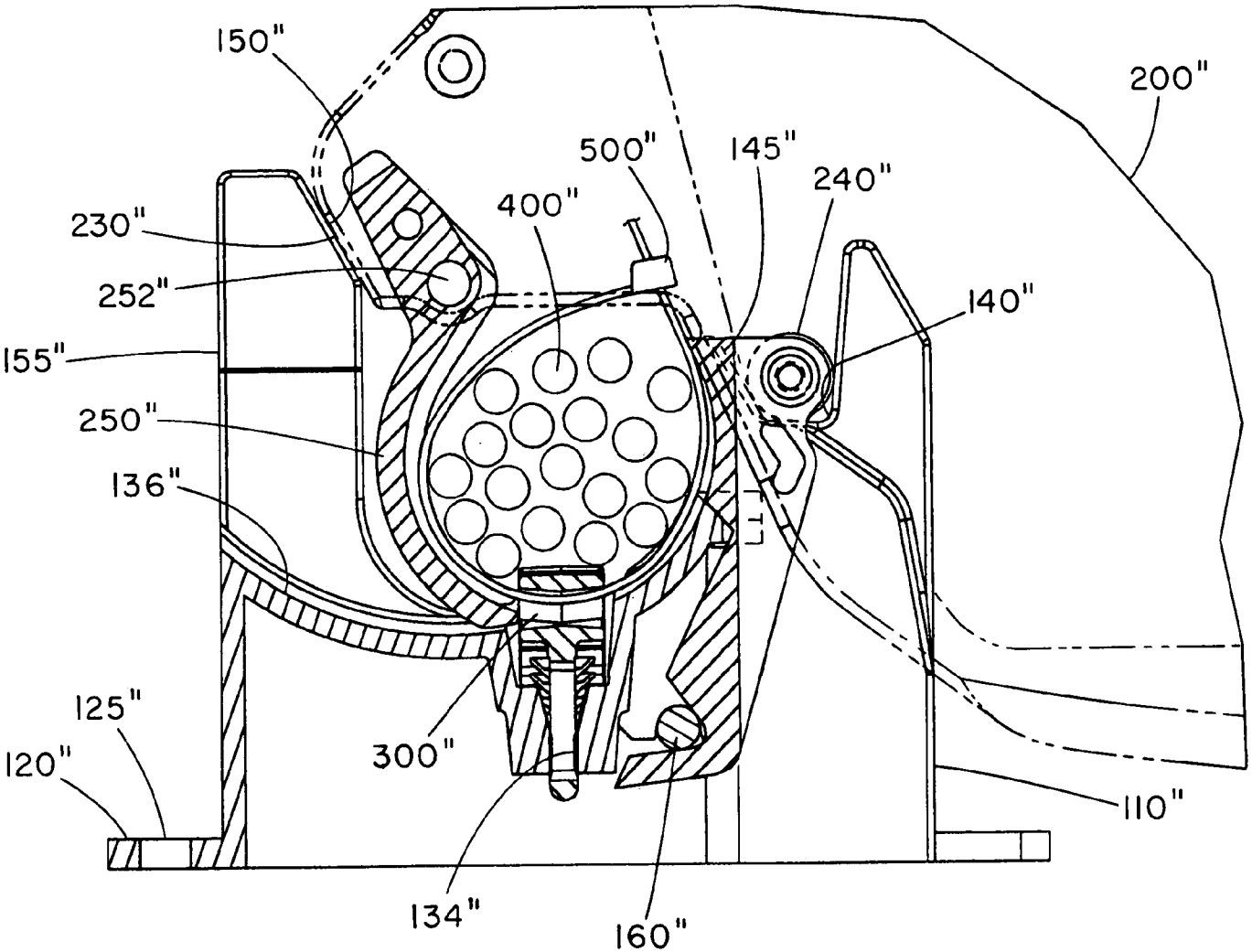
FIG. 31 is a side view of the harness board fixture of FIG. 28, showing the cable tie tool mountably positioned thereon in a closed jaw position that closely encircles the wire bundle positioned on the harness board fixture.

Operation of the cable tool 200" and harness board fixture 100" in this embodiment is similar to that of the assembly in FIG. 16. A push mount 300" is optionally provided in push mount receiving cavity 132". A bundle of cable wires 400" is then initially placed on one or more cable support surfaces 130" of one or more harness board fixtures 100" to form a wiring harness. Once the bundles 400" are suitably positioned, cable tie installation tool 200" is mounted onto fixture 100" over bundle 400" by alignment of locating features as shown in FIG. 31.

Cable tool 200" is then actuated, sending a cable tie 500" into head 200" and advanced around the wire bundle 400" and through push mount 300". Movement of cable tie 500" is similarly constrained about a path defined by the front jaw 250" and by arcuate channel 136" in cable support surface 130".

Front jaw 250" then rotates about pivot joint 252" to a closed position as shown to fully thread the cable tie. Cable tie 500" is then tensioned and cut off, pulling push mount 300" out of harness board fixture 100". Upon completion, rear jaw 260" is retracted as in the prior embodiment. Then, once all necessary cable ties 500" are installed on wire bundle 400", the completed wire harness formed by wire bundle 400" can be removed from the harness board fixtures 100".

The disclosed invention provides a harness board fixture that receives a push mount. The push mount and a cable tie may be applied to a wire bundle with an automatic cable tie tool. It should be noted that the above-described and illustrated embodiments and preferred embodiments of the invention are not an exhaustive list of the forms such a harness board fixture in accordance with the invention might take; rather, they serve as exemplary and illustrative of embodiments of the invention as presently understood. Many other forms of the invention are believed to exist.

What is claimed is:

1. A harness board fixture that can readily and securely mount an automatic cable tie tool used to apply a cable tie to a wire bundle positioned on the fixture, comprising:

a main body defining an arcuate wire bundle support surface:

a base mountable to a support surface; and tool locating features for precisely mounting the automatic cable tie tool to the fixture, the locating features including at least one tool locating saddle provided on the main body for securely receiving at least one tool locating stud on the automatic cable tie tool and constraining fore and aft movement of the tool: and at least one tool locating pad provided on the main body spaced from the tool locating saddle for mating with a corresponding locating feature on the automatic cable tool, wherein at least one sensor is mounted to the main body to detect mounting of the automatic cable tie tool to the fixture.

2. The harness board fixture of claim 1, wherein the at least one tool locating saddle includes a pair of tool locating saddles.

3. The harness board fixture of claim 1, wherein the at least one tool locating saddle and the at least one tool locating pad are on opposite sides of the arcuate wire bundle support surface.

4. The harness board fixture of claim 1, wherein the at least one tool locating saddle and the at least one tool locating pad are on a same side of the arcuate wire bundle support surface.

5. The harness board fixture of claim 4, wherein a front side of the fixture opposite the tool locating saddle and the tool locating pad is open to define a readily accessible wire bundle entrance and exit path from the front side.

6. The harness board fixture of claim 1, wherein an angled guide surface is provided on at least one of the tool locating features, allowing rough initial placement of the tool and guiding of the tool to a precise alignment position.

7. The harness board fixture of claim 1, wherein the arcuate wire bundle support surface includes a recessed cavity that releasably secures a push mount in the path of a cable tie.

8. The harness board fixture of claim 7, wherein at least one sensor is mounted to the main body to detect positioning of the push mount in the recessed cavity.

9. A harness board fixture that can readily and securely mount an automatic cable tie tool used to apply a cable tie to a wire bundle positioned on the fixture, comprising:

a main body defining an arcuate wire bundle support surface:

a base mountable to a support surface: and tool locating features for precisely mounting the automatic cable tie tool to the fixture, the tool locating features including at least one tool locating saddle provided on the main body on one side of the wire bundle support surface for securely receiving at least one tool locating stud on the automatic cable tie tool: and at least one tool locating pad provided on the main body spaced from the tool locating saddle on the same side of the wire bundle support surface for mating with a corresponding locating feature on the automatic cable tool, wherein a front side of the fixture opposite the locating features remains open to define a readily accessible wire bundle entrance and exit path from the front side.

10. The harness board fixture of claim 9, wherein he arcuate wire bundle support surface includes a recessed cavity that releasably secures a push mount in the path of a cable tie.

11. A harness board fixture and push mount assembly that can readily and securely mount an automatic cable tie tool used to apply a cable tie to a push mount and a wire bundle positioned on the fixture, comprising:

a main body defining an arcuate wire bundle support surface, the arcuate wire bundle support surface including a recessed cavity having a retention latch that releasably secures a push mount in the path of a cubic tie;

a base mountable to a support surface: and tool locating features for precisely mounting the automatic cable tie tool to the fixture, the tool locating features including at least one tool locating saddle provided on the main body on one side of the arcuate wire bundle support surface for securely receiving at least one tool locating stud on the automatic cable tie tool, and at least one tool locating pad provided on the main body spaced from the tool locating saddle for mating with a corresponding locating feature on the automatic cable tool.

12. The harness board fixture and push mount assembly of claim 11, wherein at least one of the tool locating features includes an angled guide surface that allows rough initial placement of the tool and guiding of the tool to a precise alignment position.

13. The harness board fixture and push mount assembly of claim 11, wherein the main body includes at least one removable adapter that can adapt the fixture to cable tie operations with or without a push mount.

14. The harness board fixture and push mount assembly of claim 11, wherein the recessed cavity is oriented to retain the push mount substantially perpendicular to the base.

15. The harness board fixture and push mount assembly of claim 14, wherein the recessed cavity is oriented to retain the push mount at an angle $\alpha$ of between 0 and 20 degrees from perpendicular.

16. The harness board fixture and push mount assembly of claim 11, wherein the push mount includes an outwardly protruding retention element and the retention latch includes at least one flexible cantilevered arm that yields to allow insertion of the push mount but interengages the retention element of the push mount to releaseably retain the push mount on the fixture.

17. The harness board fixture and push mount assembly of claim 11, wherein the push mount includes a retention cavity and the retention latch includes at least one flexible arm that yields to allow insertion of the push mount but interengages the cavity within the push mount to releasably retain the push mount on the fixture.

18. The harness board fixture and push mount assembly of claim 17, wherein the retention cavity is elongated and the retention latch allows limited vertical movement of the push mount relative to the fixture.

19. The harness board fixture and push mount assembly of claim 17, wherein the retention latch releasably secures the push mount in a fixed vertical position.

20. A harness board Fixture that can readily and securely mount an automatic cable tie tool used to apply a cable tie to a wire bundle positioned on the fixture, comprising:

a main body defining an arcuate wire bundle support surface;

a base mountable to a support surface; and tool locating features for precisely mounting the automatic cable tie tool to the fixture, the locating features including at least one tool locating saddle provided on the main body for securely receiving at least one tool locating stud on the automatic cable tie tool and constraining fore and aft movement of the tool: and at least one tool locating pad provided on the main body spaced from the tool, locating saddle for mating with a corresponding locating feature on the automatic cable tool, wherein the arcuate wire bundle support surface includes a recessed cavity that releasably secures a push mount in the path of a cable tie, and wherein at least one sensor is mounted to the main body to detect positioning of the push mount in the recessed cavity.

21. The harness board fixture of claim 9, wherein the arcuate wire bundle support surface includes a recessed cavity that releasably secures a push mount in the path of a cable tie.

22. The harness hoard fixture of claim 21, wherein at least one sensor is mounted to the main body to detect positioning of the push mount in the recessed cavity.

23. The harness hoard fixture of claim 9, wherein at least one sensor is mounted to the main body to detect mounting of the automatic cable tie tool to the fixture.

24. The harness board fixture and push mount assembly of claim 11, wherein at least one sensor is mounted to the main body to detect positioning of the push mount in the recessed cavity.

25. The harness board fixture and push mount assembly of claim 11, wherein at least one sensor is mounted to the main body to detect mounting of the automatic cable tic tool to the fixture.

* * * * *

UNITED STATES PATENT AND TRADEMARK OFFICE

CERTIFICATE OF CORRECTION

PATENT NO. : 7,334,610 B2
APPLICATION NO. : 11/248568
DATED : February 26, 2008
INVENTOR(S) : Robert F. Levin et al.

It is certified that error appears in the above-identified patent and that said Letters Patent is hereby corrected as shown below:

Claim 1, Column 8, lines 47-48 which reads "a main body defining an arcuate wire bundle support surface:" should read --a main body defining an arcuate wire bundle support surface;--

Claim 1, Column 8, line 56 which reads "fore and aft movement of the tool:" should read --fore and aft movement of the tool;--

Claim 9, Column 9, line 29 which reads "a base mountable to a support surface: and" should read --a base mountable to a support surface; and--

Claim 9, Column 9, line 36 which reads "on the automatic cable tie tool:" should read --on the automatic cable tie tool;--

Claim 11, Column 9, line 58 which reads "a base mountable to a support surface: and" should read --a base mountable to a support surface; and--

Column 20, Column 10, line 41 which reads "a harness board Fixture that can readily and securely" should read --a harness board fixture that can readily and securely--

Claim 20, Column 10, line 55 which reads "spaced from the tool, locating saddle for mating with" should read --spaced from the tool locating saddle for mating with--

Claim 20, Column 10, line 56 which reads "fore and aft movement of the tool:" should read --fore and aft movement of the tool;--

Signed and Sealed this

Fifth Day of August, 2008

JON W. DUDAS
*Director of the United States Patent and Trademark Office*